US006662139B2

(12) United States Patent
Inoue et al.

(10) Patent No.: US 6,662,139 B2
(45) Date of Patent: Dec. 9, 2003

(54) DRAWING APPARATUS AND METHOD OF ATTACHING BALANCE WEIGHTS

(75) Inventors: Masao Inoue, Kyoto (JP); Yasuyuki Koyagi, Kyoto (JP); Toru Kawada, Kyoto (JP); Toshio Tamura, Kyoto (JP); Junichi Nagamine, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/201,700

(22) Filed: Jul. 24, 2002

(65) Prior Publication Data

US 2003/0088383 A1 May 8, 2003

Related U.S. Application Data

(62) Division of application No. 09/249,088, filed on Feb. 12, 1999, now Pat. No. 6,505,142.

(30) Foreign Application Priority Data

| | | |
|---|---|---|
| Feb. 13, 1998 | (JP) | 10-031830 |
| Feb. 24, 1998 | (JP) | 10-042284 |
| Aug. 5, 1998 | (JP) | 10-222130 |
| Nov. 16, 1998 | (JP) | 10-325116 |
| Nov. 16, 1998 | (JP) | 10-325117 |

(51) Int. Cl.[7] ..... G06C 23/00

(52) U.S. Cl. ..... 702/173; 702/150; 101/375; 101/378

(58) Field of Search ..... 702/173, 33–36, 702/95, 40–43, 85, 94, 97, 101, 105, 113, 114, 127, 150–152, 167, 175, FOR 130, FOR 123–FOR 126, FOR 134–FOR 136, FOR 144–FOR 147, FOR 141, FOR 155–FOR 163, FOR 152, FOR 170, FOR 171; 101/375–378, 486, 401.1, 415.1, 485, 409, 463.1, 467, 410, 483, 484, 477; 346/138, 134, 136; 73/468–470, 66, 457–460; 700/279, 275, 302; 74/573 R; 347/261

(56) References Cited

U.S. PATENT DOCUMENTS

| | | | | | |
|---|---|---|---|---|---|
| 4,824,096 | A | | 4/1989 | Fichter et al. | 101/410 |
| 4,903,957 | A | | 2/1990 | Binder et al. | 346/138 |
| 5,335,046 | A | * | 8/1994 | Bosy | 355/73 |
| 5,685,226 | A | * | 11/1997 | Fuller | 101/415.1 |
| 5,713,288 | A | * | 2/1998 | Frazzitta | 101/492 |
| 5,813,346 | A | | 9/1998 | Solomon | 101/483 |
| 5,903,300 | A | | 5/1999 | Suzuki | 347/261 |

* cited by examiner

*Primary Examiner*—Hal Wachsman
(74) *Attorney, Agent, or Firm*—Arent Fox Kintner Plotkin & Kahn, PLLC

(57) ABSTRACT

Front end clamps are disposed on the cylindrical surface of a recording drum, and rear end clamps are attached in any of a plurality of positions at the cylindrical surface of the recording drum. A controller controls a front end clamp opening/closing device to open the front end clamps and controls a pair of rollers to feed a plate held on a plate carry-in path. The controller also controls the front end clamp opening/closing device to close the plate fixing portion of the front end clamps to fix the front end of the plate on the cylindrical surface, controls a driving device to rotate the recording drum for a predetermined amount, and controls a rear end clamp attaching/detaching device to attach the rear end clamps to the cylindrical surface to fix the rear end of the plate on the recording drum cylindrical surface.

11 Claims, 28 Drawing Sheets

FIG. 13(a)
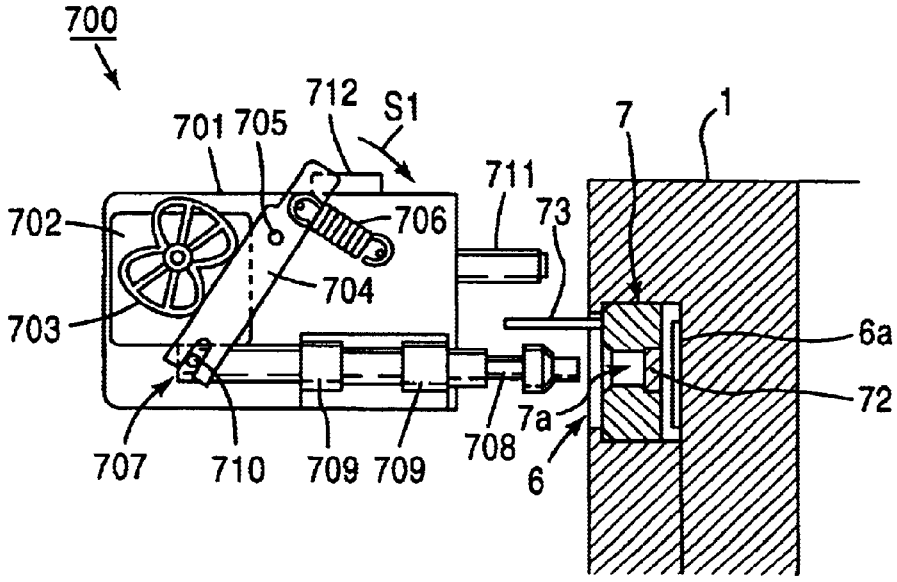
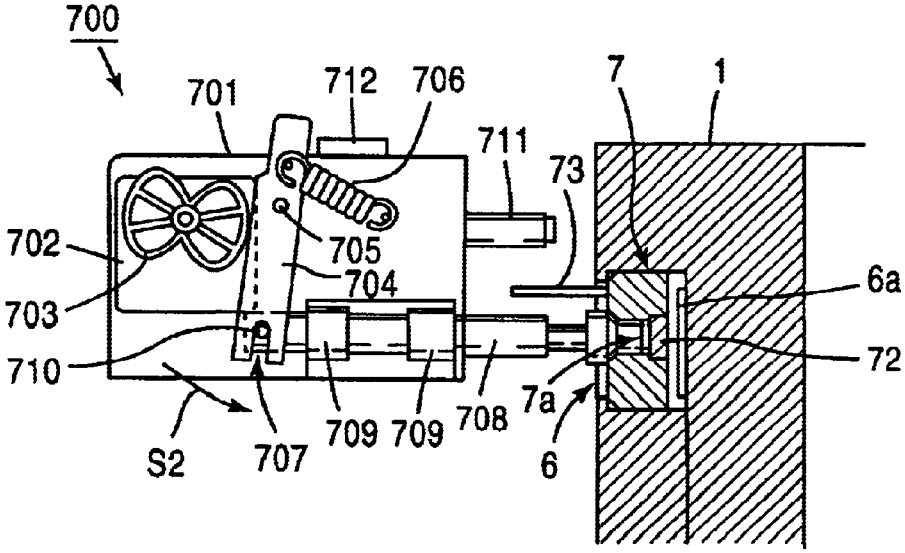
FIG. 13(b)

FIG. 33(a)
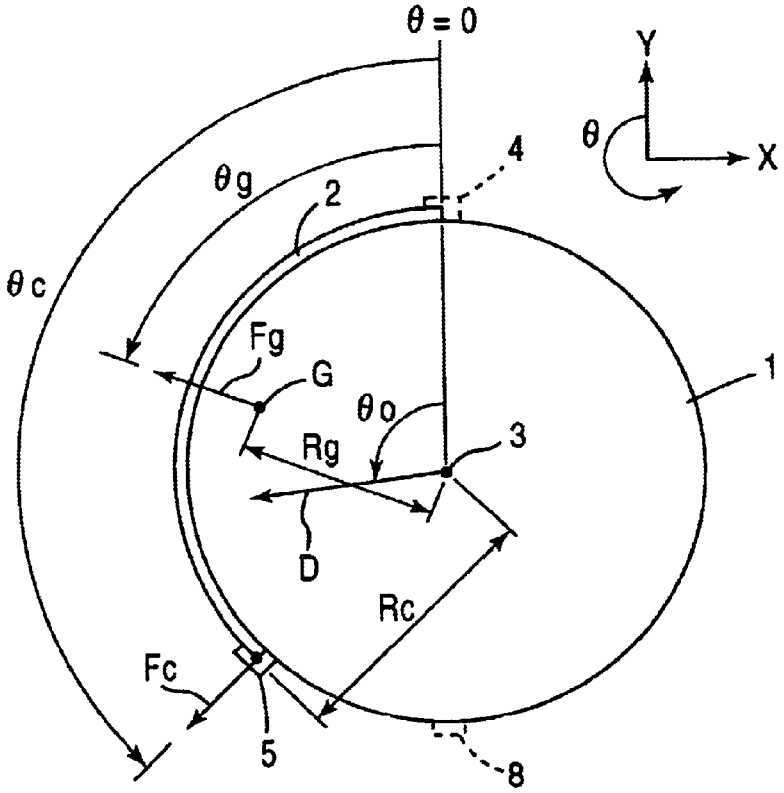
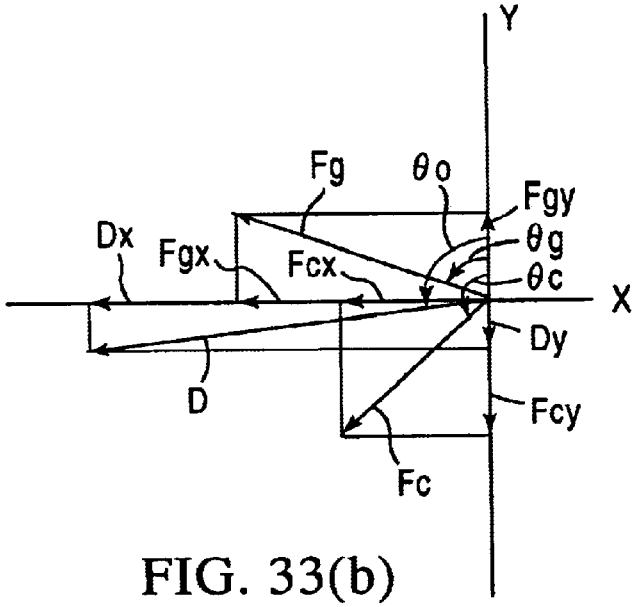
FIG. 33(b)

DRAWING APPARATUS AND METHOD OF ATTACHING BALANCE WEIGHTS

This is a Division of application Ser. No. 09/249,088 filed Feb. 12, 1999, now U.S. Pat. No. 6,505,142. The disclosure of the prior application is hereby incorporated by reference herein in its entirety.

BACKGROUND OF THE INVENTION

1. Field of the Invention

The present invention relates generally to a drawing apparatus for performing drawing on a recording material such as a plate mounted on a drum and a method of attaching balance weights for adjusting a balanced state at the time of rotating the drum.

2. Description of the Background Art

A drawing apparatus for performing drawing upon irradiation of various types of photosensitive materials with light has been used. In a drum-type drawing apparatus, a photosensitive material is attached to a recording drum which is rotatable in a primary scanning direction, and a recording head comprising a laser diode and the like is moved in a secondary scanning direction parallel to a rotary shaft of the recording drum, to perform drawing on the photosensitive material.

FIG. 37 is a schematic perspective view of a recording drum of a conventional drawing apparatus. A recording drum 1 shown in FIG. 37 is so constructed that a plate 2 made of aluminum can be mounted thereon as a photosensitive material. A fixing clamp 4 for fixing one end of the plate 2 and a movable clamp 5 for fixing the other end of the plate 2 are provided on an outer peripheral surface of the recording drum 1. The movable clamp 5 is formed so as to be movable on the outer peripheral surface of the recording drum 1 depending on the size of the plate 2. The recording drum 1 to which the plate 2 is attached is rotated at relatively low speed around the rotary shaft 3, so that drawing is performed on the surface of the plate 2.

In recent years, it has been needed to improve the efficiency of drawing processing on the plate 2. Therefore, it has been examined whether the recording drum 1 to which the plate 2 is attached is rotated at high speed to perform a drawing operation.

However, the plate 2 made of aluminum is heavier than a film material or the like, and is attached in an offset state to a part of the outer peripheral surface of the recording drum 1. When the recording drum 1 is rotated at high speed, therefore, a centrifugal force developed by the plate 2 causes an unbalance force to be exerted on the rotary shaft of the recording drum 1. The fixing clamp 4 and the movable clamp 5 are provided on the outer peripheral surface of the recording drum 1. The fixing clamp 4 and the movable clamp 5 respectively have corresponding masses. When the recording drum 1 is rotated at high speed, similarly to the plate 2, therefore, centrifugal forces developed by the fixing clamp 4 and the movable clamp 5 cause an unbalance force.

When the unbalance force 5 caused by the plate 2, the fixing clamp 4 and the movable clamp 5 is exerted on the recording drum 1, forced vibration may occur in bearings for supporting the rotary shaft 3 of the recording drum 1 when the recording drum 1 is rotated at high speed, so that the recording drum may develop a fault. The production of such an unbalance force presents no problem when the recording drum 1 is rotated at low speed, as in the conventional example, while presenting a large problem as the recording drum 1 is rotated at high speed in order to make the drawing operation efficient.

SUMMARY OF THE INVENTION

An object of the present invention is to provide a drawing apparatus in which no forced vibration occurs by an unbalance between centrifugal forces at the time of rotation and a method of attaching balance weights.

A drawing apparatus according to the present invention is a drawing apparatus for drawing an image on a recording material, comprising a cylindrical drum having a rotary shaft and an outer peripheral surface, driving means for rotating the drum around the rotary shaft, a fixing member provided on the outer peripheral surface of the drum for fixing the recording material to the outer peripheral surface of the drum, a plurality of balance weights provided so as to be movable and fixable along a circumference whose center coincides with the rotary shaft of the drum, and position calculation means for calculating, on the basis of information relating to the recording material and the fixing member, the positions of the plurality of balance weights for canceling an unbalance force caused by centrifugal forces developed by the fixing member and the recording material at the time of rotating the drum.

In the drawing apparatus, the recording material is mounted on the outer peripheral surface of the cylindrical drum by the fixing member, and is rotated by the driving means. An image is drawn onto the recording material which is rotated as the drum is rotated. The fixing member and the recording material which are provided on the outer peripheral surface of the cylindrical drum respectively develop centrifugal forces in different directions at the time of rotating the drum. Therefore, the unbalance force caused by the centrifugal forces developed by the recording material and the fixing member is exerted on the rotary shaft of the drum.

On the other hand, the plurality of balance weights are provided along the circumference whose center coincides with the rotary shaft of the drum. Each of the balance weights develops the centrifugal force by the rotation of the drum. The plurality of balance weights are arranged such that a composite force of the centrifugal forces developed by the balance weights is balanced with the unbalanced force caused by the recording material and the fixing member. Even when the drum is rotated, therefore, the unbalance force is prevented from being exerted on the rotary shaft. Therefore, it is possible to prevent the drum from developing a fault by forced vibration occurring in the rotary shaft of the drum. The plurality of balance weights are provided so as to be movable and fixable along the circumference whose center coincides with the rotary shaft of the drum. Even when the weight and the size of the recording material are changed, therefore, it is possible to cancel the unbalance force caused by the recording material and the fixing member by changing the positions of the plurality of balance weights.

The position calculation means calculates the positions of the balance weights on the basis of the information relating to the recording material and the fixing member. Even when a different type of recording material is used, therefore, it is possible to calculate the most suitable position of the balance weight depending on the type.

The cylindrical drum may further have two end surfaces disposed on opposite sides thereof, and the plurality of balance weights may comprise at least two balance weights provided on each of both the end surfaces of the drum so as to be movable and fixable along the circumference.

In this case, at least two balance weights are provided on each of both the end surfaces of the drum. Even when the weight and the size of the recording material are changed, therefore, it is possible to cancel the unbalance force caused by the recording material and the fixing member by changing the positions of the balance weights.

An annular groove whose center coincides with the rotary shaft may be formed on each of both the end surfaces of the drum, and the plurality of balance weights may be provided so as to be movable and fixable along the annular groove.

In this case, it is easy to move and position the plurality of balance weights by providing the annular grooves.

Each of the plurality of balance weights may include a magnet which is attractable to each of both the end surfaces of the drum.

The balance weight includes a magnet, thereby making it possible to easily move and fix the balance weights on both the end surfaces of the drum without using a special structure.

The drawing apparatus may further comprise movement means for moving the plurality of balance weights to the positions calculated by the position calculation means.

In this case, the movement means can move the plurality of balance weights. Therefore, it is possible to rotate the drum at high speed without causing forced vibration in the rotary shaft of the drum irrespective of the type of the recording material.

The movement means may comprise engagement means for engaging one of the balance weights provided on the drum, and control means for rotating the drum by activating the driving means in a state where the balance weight is engaged by the engagement means, to move the balance weight to the position calculated by the position calculation means.

The engagement means engages one of the balance weights, to stop the balance weight in the position. In this state, the driving means rotates the drum, thereby making it possible to move the position of the balance weight on the end surface of the drum to a predetermined position.

The drawing apparatus may further comprise storage means for storing the position information of each of the balance weights on each of the end surfaces of the drum, and the control means may rotate the drum by activating the driving means to the position where the balance weight is to be engaged by the engagement means on the basis of the position information stored in the storage means.

In this case, the storage means stores the position information of the balance weights on the end surface of the drum. Therefore, the control means takes out the position information from the storage means, and refers to the position information to rotate the drum, so that the engagement means can easily engage the balance weights.

The drawing apparatus may further comprise detection means for obtaining the position information of each of the balance weights on each of the end surfaces of the drum, and the control means may rotate the drum by activating the driving means to the position where the balance weight is to be engaged by the engagement means on the basis of the position information obtained by the detection means.

In this case, the position information of each of the balance weights on each of the end surfaces of the drum is obtained by the detection means. The control means rotates the drum on the basis of the obtained position information of the balance weight, so that the engagement means can easily engage the balance weight.

The drawing apparatus may further comprise input means for inputting the information relating to the recording material.

The information relating to various types of recording materials are inputted using the input means. The position calculation means calculates the positions of the plurality of balance weights on the basis of the information inputted from the input mean. When a different type of recording material is used, therefore, it is possible to arrange the plurality of balance weights in the most suitable positions irrespective of the type of the recording material by inputting the information.

The position calculation means may calculate, on the basis of the information relating to the recording material and the fixing member, an unbalance amount caused by the recording material and the fixing member, and calculate the positions of the plurality of balance weights such that a weighting amount caused by the plurality of balance weights is balanced with the unbalance amount.

Consequently, it is possible to easily calculate the positions of the plurality of balance weights such that the weighting amount caused by the plurality of balance weights are balanced with the unbalance amount caused by the rotation of the fixing member and the recording material.

The drawing apparatus may further comprise information detection means for detecting the information relating to the recording material mounted on the drum.

In this case, the information relating to the recording material mounted on the drum is detected, and the positions of the plurality of balance weights are calculated such that the unbalance force caused by the centrifugal forces exerted on the drum is canceled on the basis of the detected information. Even when the setting of the information relating to the recording material is erroneous, forced vibration is prevented from occurring in the drum by the unbalance force at the time of rotating the drum.

The information detection means may detect the size of the recording material mounted on the drum.

In this case, the size of the recording material mounted on the drum is detected. Even when the setting of the size of the recording material is erroneous, therefore, forced vibration is prevented from occurring by the unbalance force at the time of rotating the drum.

The drawing apparatus may further comprise unbalance detection means for detecting the presence or absence of an unbalance force caused by the centrifugal forces exerted on the drum.

In this case, the presence or absence of the unbalance force caused by the centrifugal forces exerted on the drum is detected, thereby making it possible to prevent the forced vibration from occurring by the unbalance force at the time of rotating the drum.

The unbalance detection means may comprise driving release means for releasing a driving force of the driving means, to bring the drum into a free state from the driving means, rotation detection means for detecting whether or not the drum is rotated after being brought into a free state by the driving release means, and judgment means for judging the presence or absence of the unbalance force on the basis of the result of the detection by the rotation detection means.

In this case, the driving force of the driving means is released, so that the drum is brought into a free state from the driving means. When the unbalance force exists, the drum is rotated. Therefore, it is possible to judge the presence or absence of the unbalance force by detecting whether or not the drum is rotated.

The judgment means may judge that the unbalance force exists when the rotation of the drum is detected, while rotating the drum through a predetermined angle by activating the driving means and then releasing the driving force of the driving means by the driving release means when no rotation of the drum is detected, and judging that the unbalance force exists when the rotation of the drum is detected, while judging that the unbalance force does not exist when no rotation of the drum is detected.

When the drum is rotated after being brought into a free state, it is possible to judge that the unbalance force exists. Even in a case where the unbalance force exists, when the direction of the unbalance force coincides with the direction of gravity when the drum is brought into a free state, the drum is not rotated. When it is not detected that the drum is rotated, therefore, the drum is rotated through a predetermined angle by the driving means, and is then brought into a free state. When the drum is rotated in this state, it can be judged that the unbalance force exits. When the drum is not rotated in this state, it can be judged that the unbalance force does not exist.

In a drawing apparatus for drawing an image on a recording material while rotating a cylindrical drum on which the recording material is mounted by a fixing member, a method of attaching unbalance weights according to another aspect of the present invention is a method of attaching on the drum a plurality of balance weights for canceling an unbalance force caused by centrifugal forces developed by the recording material and the fixing member at the time of rotating the drum, which comprises the steps of calculating, on the basis of information relating to the recording material and the fixing member, the positions of the plurality of balance weights for canceling the unbalance force, the positions of the plurality of balance weights being determined along a circumference whose center coincides with a rotary shaft of the drum, and attaching the plurality of balance weights to the calculated positions.

In the method of attaching the balance weights, it is possible to attach the balance weights along the circumference whose center coincides with the rotary shaft of the drum such that the unbalance force caused by the fixing member and the recording material is canceled. Consequently, it is possible to perform drawing while rotating the drum at high speed without causing forced vibration in the rotary shaft of the drum.

The plurality of balance weights may be at least two balance weights provided on each of both the end surfaces of the drum along the circumference.

In this case, it is possible to mount at least two balance weights on each of both the end surfaces of the drum so as to cancel the unbalance force caused by the fixing member and the recording material. Consequently, it is possible to perform drawing while rotating the drum at high speed without causing forced vibration in the rotary shaft of the drum.

The step of calculating the positions may comprise the steps of calculating, on the basis of the information relating to the recording material and the fixing member, an unbalance amount caused by the recording material and the fixing member, and calculating the positions of the plurality of balance weights such that a weighting amount caused by the plurality of balance weights is balanced with the unbalance amount.

Consequently, the unbalance amount caused by the recording material and the fixing member is calculated for each drawing processing of various types of recording materials, and the positions of the plurality of balance weights are calculated such that the weighting amount caused by the balance weights is balanced with the unbalance amount. The balance weights are attached to both the end surfaces of the drum on the basis of the calculated positions of the balance weights, thereby making it possible to prevent forced vibration from occurring in the rotary shaft of the drum.

A drawing apparatus according to still another aspect of the present invention is a drawing apparatus for drawing an image on a recording material, which comprises a cylindrical drum having a rotary shaft and an outer peripheral surface, driving means for rotating the drum around the rotary shaft, a fixing member provided on the outer peripheral surface of the drum for fixing the recording material to the outer peripheral surface of the drum, and a pair of balance weights, each of which is provided at each of ends of the drum so as to be movable and fixable along a circumference whose center coincides with the rotary shaft of the drum and a radius of the circumference.

In the drawing apparatus, the recording material is attached to the outer peripheral surface of the cylindrical drum by the fixing member, and is rotated by the driving means. Drawing is performed onto the recording material which is rotated as the drum is rotated. The fixing member and the recording material which are provided on the outer peripheral surface of the cylindrical drum respectively develop centrifugal forces in different directions at the time of rotating the drum. Therefore, the unbalance force caused by the centrifugal forces developed by the recording material and the fixing member is exerted on the rotary shaft of the drum.

On the other hand, the pair of balance weights is provided at each of both the ends of the drum. Each of the balance weights develops a centrifugal force by the rotation of the drum. The pair of unbalance weights is arranged such that the composite force of the centrifugal forces developed by the pair of balance weights is balanced with the unbalance force caused by the recording material and the fixing member. Even when the drum is rotated, therefore, the unbalance force is prevented from being exerted on the rotary shaft, so that the drum can be prevented from developing a fault by forced vibration occurring in the rotary shaft of the drum. The pair of balance weights provided at each of both the ends of the drum is provided so as to be movable and fixable along the circumference and the radius of the drum. Even when the weight and the size of the recording material are changed, therefore, it is possible to cancel the unbalance force caused by the recording material and the fixing member by changing the position of each of the balance weights in the radial direction and the circumferential direction.

The cylindrical drum may further have two end surfaces disposed on opposite sides thereof, and each of the pair of balance weights may be provided on each of the end surfaces of the drum.

In this case, each of the balance weights is provided on each of the end surfaces of the drum so as to be movable and fixable along the circumference and the radius of the drum. Even when the weight and the size of the recording material are changed, therefore, it is possible to cancel the unbalance force caused by the recording material and the fixing member by changing the position of each of the balance weights in the radial direction and the circumferential direction.

Each of the pair of balance weights may include a magnet which is attractable to each of both the end surfaces of the drum.

By composing the balance weights of the magnet, the balance weights can be easily moved on both the end surfaces of the drum and fixed thereto without using a special structure.

The drawing apparatus may further comprise position calculation means for calculating, on the basis of information relating to the recording material and the fixing member, the positions of the pair of balance weights for canceling an unbalance force caused by centrifugal forces developed by the fixing member and the recording material at the time of rotating the drum, and movement means for moving the pair of balance weights to the positions calculated by the position calculation means.

In this case, the position calculation means calculates the positions of the balance weights on the basis of the information relating to the recording material and the fixing member. Even when a different type of recording material is used, therefore, it is possible to calculate the most suitable position of the balance weight depending on the type. Consequently, the movement means can move the pair of balance weights. Therefore, it is possible to rotate the drum at high speed without causing forced vibration in the rotary shaft of the drum irrespective of the type of the recording material.

The position calculation means may calculate the respective positions, along the radius and the circumference, of the balance weights on each of the end surfaces of the drum, and the movement means may comprise engagement means to be engaged with one of the balance weights provided on each of the end surfaces of the drum, the engagement means being movable along the radius, and control means for moving the engagement means to transfer the balance weight to the calculated position along the radius on the end surface of the drum, and for rotating the drum by activating the driving means in a state where the balance weight is engaged with the engagement means, to transfer the balance weight to the calculated position along the circumference on the end surface of the drum.

In this case, the engagement means is engaged with each of the balance weights, and is moved in the radial direction, to define the position, along the radius on the end surface of the drum, of the balance weight. Further, the driving means rotates the drum in a state where the engagement means is engaged with the balance weight, so that the position, along the circumference on the end surface of the drum, of the balance weight is defined. Consequently, the balance weight is moved to a predetermined position on the end surface of the drum, thereby making it possible to cancel the unbalance force caused at the time of rotating the drum.

The drawing apparatus may further comprise storage means for storing the position information of each of the balance weights on each of the end surfaces of the drum, and the control means may move the engagement means and rotates the drum on the basis of the position information stored in the strage means, whereby the engagement means being engaged with the balance weight.

In this case, the storage means stores the position information of the pair of balance weights on the end surface of the drum. Therefore, the control means takes out position information of the balance weights from the storage means, refers to the position information, to move the engagement means in the radial direction, and rotates the drum, thereby making it possible to easily engage the engagement means with the balance weights.

The drawing apparatus may further comprise input means for inputting the information relating to the recording material.

The information relating to various types of recording materials may be inputted using the input means. The position calculation means calculates the positions of the pair of balance weights on the basis of the information inputted from the input means. When a different type of recording material is used, therefore, the information is inputted, thereby making it possible to arrange the pair of balance weights in the most suitable positions irrespective of the type of the recording material.

The position calculation means may calculate, on the basis of the information relating to the recording material and the fixing member, an unbalance amount caused by the recording material and the fixing member, and calculate the positions of the pair of balance weights such that a weighting amount caused by the pair of balance weights is balanced with the unbalance amount.

Consequently, it is possible to easily calculate the positions of the pair of balance weights such that the balance weights are balanced with the unbalance amount caused by the rotation of the fixing member and the recording material.

In a drawing apparatus for drawing an image on a recording material while rotating a cylindrical drum on which the recording material is mounted by a fixing member, a method of attaching balance weights according to a further aspect of the present invention is a method of attaching to the drum a pair of balance weights for canceling an unbalance force caused by centrifugal forces developed by the recording material and the fixing member at the time of rotating the drum, which comprises the steps of calculating the positions where the pair of balance weights, each of which is provided at each of ends of the drum so as to develop centrifugal forces for canceling the unbalance force exerted on the drum, and attaching the pair of balance weights to the calculated positions.

In the method of attaching the balance weights, it is possible to mount the pair of balance weights at both the ends of the drum such that the unbalance force caused by the fixing member and the recording material is canceled. Consequently, it is possible to rotate the drum at high speed without causing forced vibration in the rotary shaft of the drum, to perform drawing.

Each of the pair of balance weights may be provided on each of both end surfaces of the drum.

In this case, it is possible to attach each of the pair of balance weights on each of both the end surfaces of the drum such that the unbalance force caused by the fixing member and the recording material is canceled. Consequently, it is possible to rotate the drum at high speed without causing forced vibration in the rotary shaft of the drum, to perform drawing.

The step of calculating the positions may comprise the steps of calculating, on the basis of information relating to the recording material and the fixing member, an unbalance amount caused by the recording material and the fixing member, and calculating the positions of the pair of balance weights such that a weighting amount caused by the pair of balance weights is balanced with the unbalance amount.

In this case, the unbalance amount caused by the recording material and the fixing member is calculated for each drawing processing of various types of recording materials. Further, the positions of the pair of balance weights are calculated such that the weighting amount caused by the balance weights is balanced with the unbalance amount. The balance weights are attached to both the end surfaces of the drum on the basis of the calculated positions of the balance weights, thereby making it possible to prevent forced vibration from occurring in the rotary shaft of the drum.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 13(*a*) and 13(*b*) are front views showing the structure and the operation of a weight position adjuster shown in FIGS. 9 and 10;

FIGS. 33(*a*) and 33(*b*) are schematic views of an unbalance force caused by centrifugal forces developed by a movable clamp and a plate in the recording drum, and diagrams showing an unbalance force vector;

DESCRIPTION OF THE PREFERRED EMBODIMENTS

Figure 1:
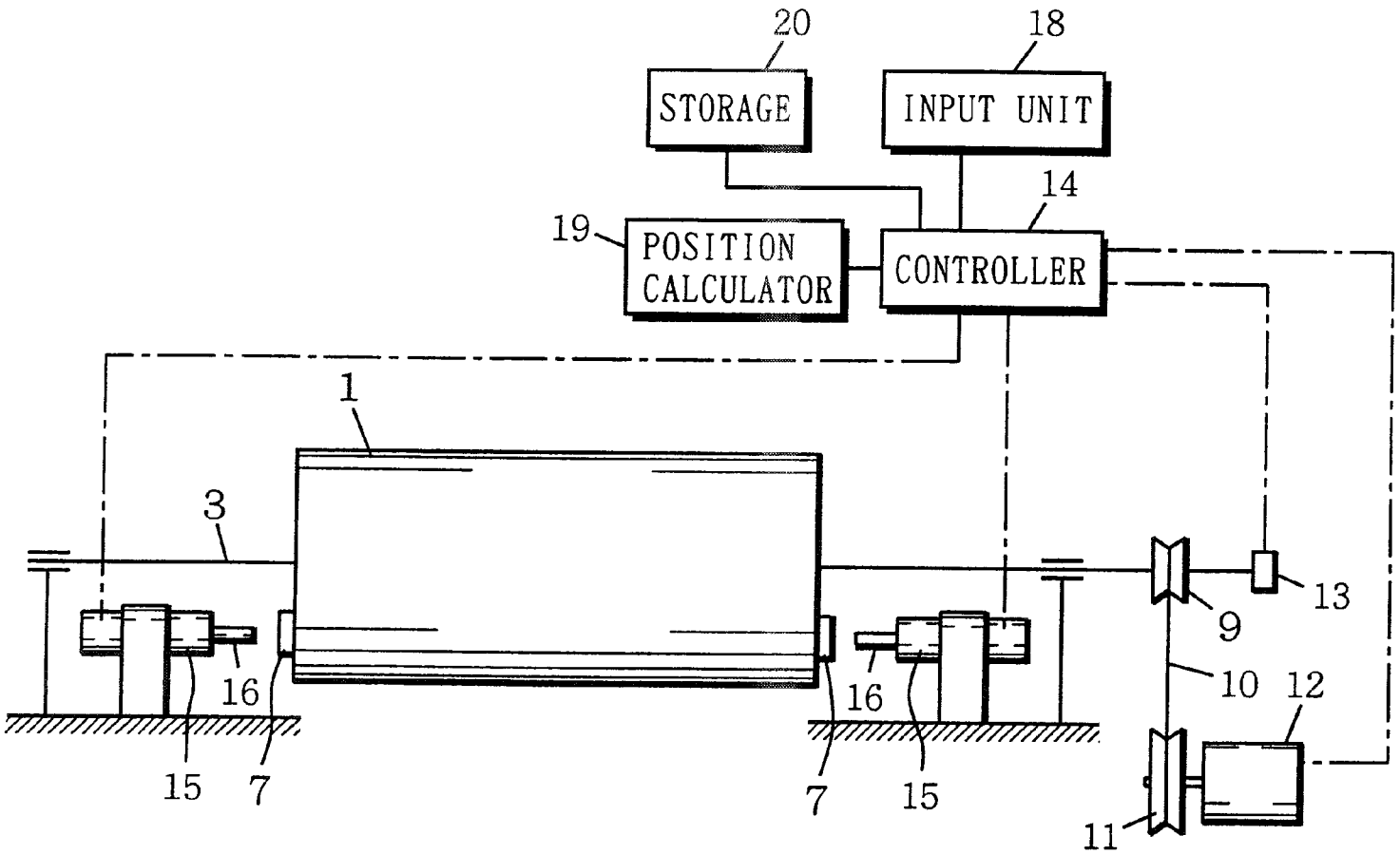
FIG. 1 is a schematic view showing the construction of a drawing apparatus according to a first embodiment of the present invention.
Figure 2:
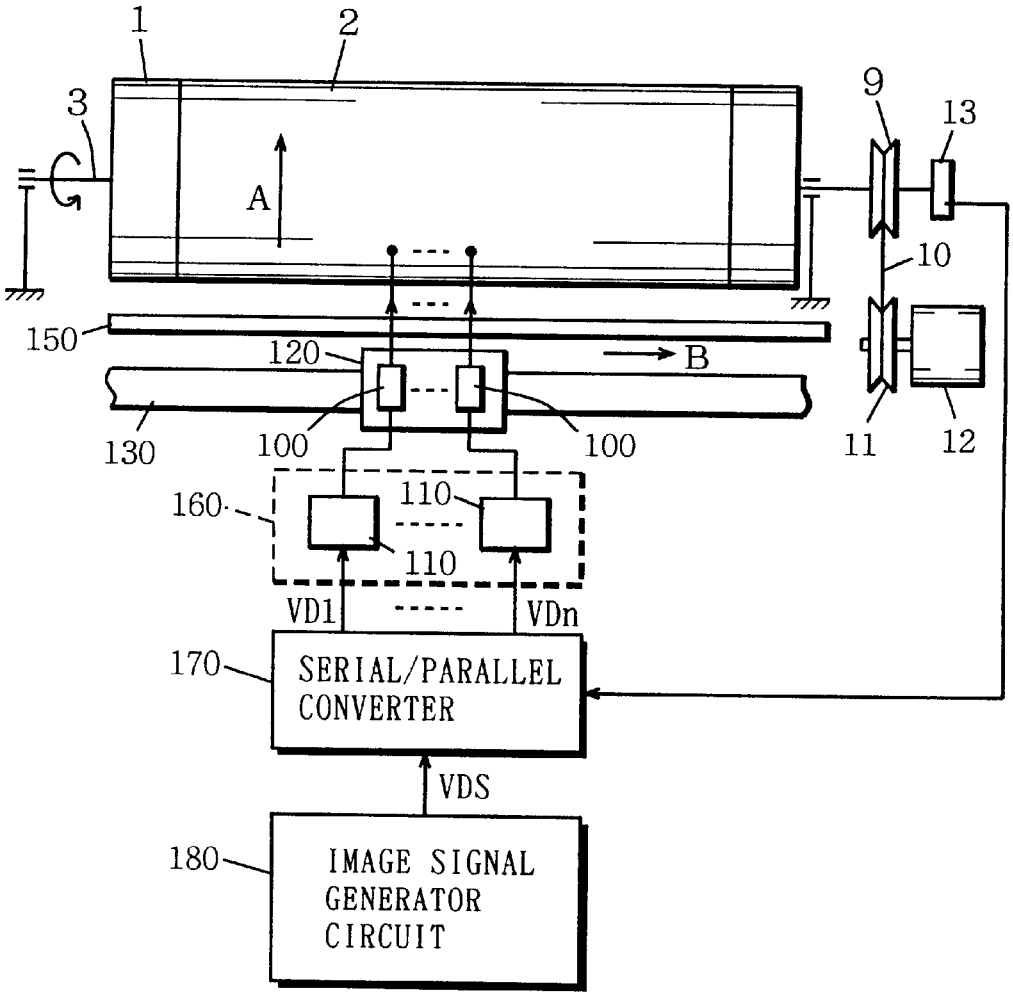
FIG. 2 is a schematic view of a principal part of the drawing apparatus shown in FIG. 1.

FIG. 1 is a schematic view of a drawing apparatus in a first embodiment of the present invention, and FIG. 2 is a schematic view of a principal part of the drawing apparatus shown in FIG. 1.

In FIG. 1, the drawing apparatus comprises a cylindrical recording drum 1. The recording drum 1 is supported so as to be rotatable around a rotary shaft 3 having both its ends supported on bearings. A driving mechanism comprising a pair of pulleys 9 and 11, a belt 10 and a motor 12 is connected to one end of the rotary shaft 3. The driving mechanism transmits the rotation of the motor 12 to the rotary shaft 3 through the pair of pulleys 9 and 11 and the belt 10, to rotate the recording drum 1.

In FIG. 2, a recording head 120 is disposed in a position opposite to an outer peripheral surface of the recording drum 1. The recording head 120 comprises a plurality of laser diodes 100. The recording head 120 is attached to a guide 130 so as to be movable, and is moved in a secondary scanning direction B in synchronization with the rotation of the recording drum 1.

The current position in a primary scanning direction A of the plate 2 is detected on the basis of a detection signal outputted from a rotation angle detector 13 attached to the rotary shaft 3 of the recording drum 1. The current position in the secondary scanning direction B of the recording head 120 is detected on the basis of a detection signal outputted from a linear encoder 150.

The plurality of laser diodes 100 in the recording head 120 are driven by a laser diode driving circuit portion 160. The laser diode driving circuit portion 160 comprises a plurality of laser diode driving circuits 110 corresponding to the plurality of laser diodes 100 in the recording head 120.

An image signal generator circuit 180 generates a serial image signal VDS. A serial/parallel converter 170 converts the serial image signal VDS generated by the image signal generator circuit 180 into parallel image signals VD1 to VDn, and respectively feeds the image signals VD1 to VDn to the plurality of laser diode driving circuits 110 in the laser diode driving circuit portion 160. Consequently, each of the laser diodes 100 in the recording head 120 is driven by the corresponding laser diode driving circuit 110, to irradiate the plate 2 with laser light.

Figure 3:
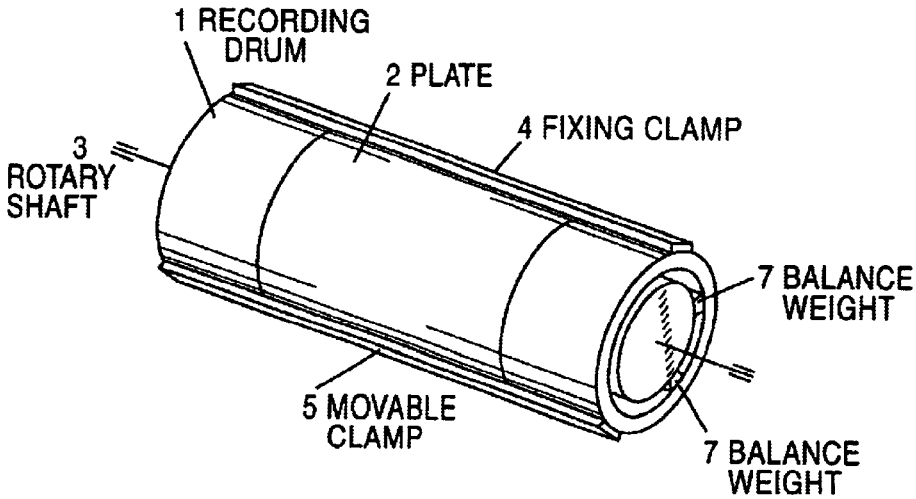
FIG. 3 is a perspective view of a recording drum.
Figure 4:
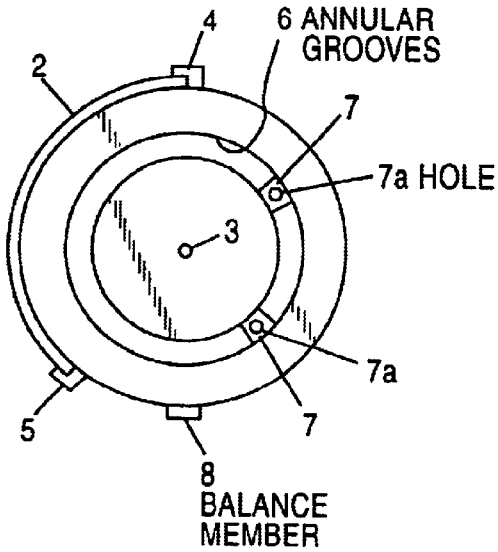
FIG. 4 is a side view of the recording drum shown in FIG. 2.

FIG. 3 is a perspective view of the recording drum, and FIG. 4 is a side view of the recording drum. A fixing clamp 4 and a movable clamp 5 for attaching the plate 2 are disposed on the outer peripheral surface of the recording drum 1. The fixing clamp 4 is fixed to the outer peripheral surface of the recording drum 1, and the movable clamp 5 is formed so as to be movable on the outer peripheral surface of the recording drum 1 depending on the size of the plate 2. A fixing clamp balance member 8 is attached to the outer peripheral surface of the recording drum 1 on the opposite side of the fixing clamp 4. The fixing clamp balance member 8 is formed so as to have an approximately equal weight to that of the fixing clamp 4. Consequently, the fixing clamp balance member 8 develops a centrifugal force which is balanced with a centrifugal force developed by the fixing clamp 4 at the time of rotating the recording drum 1, thereby preventing an unbalance force from being produced.

Annular grooves 6 whose center is the rotary shaft 3 are respectively formed on both end surfaces of the recording drum 1. Two balance weights 7 are disposed inside the annular groove 6 on each of the end surfaces. The balance weight 7 is composed of a permanent magnet, and is attracted to the end surface of the recording drum 1 made of a metal by its magnetic force. The balance weight 7 is movable to an arbitrary position of the annular groove 6. A hole 7*a* into which an adjusting pin 16 of a weight position adjuster 15 for adjusting the position of the balance weight 7 is to be inserted is formed on the surface of the balance weight 7. The balance weights 7 are arranged such that the recording drum 1 is rotatable in a state where the centrifugal force developed by the fixing clamp 4 is balanced with centrifugal forces developed by the balance weights 7. The arrangement and the operation of the balance weights 7 will be described in detail later.

In FIG. 1, a pair of weight position adjusters 15 is arranged opposite to both the end surfaces of the recording drum 1. The weight position adjuster 15 has an adjusting pin 16 which can advance and retreat to and from the end surface of the recording drum 1. The adjusting pin 16 extends at the time of adjusting the position of the balance weight 7, and enters the hole 7*a* of the balance weight 7, to inhibit the movement of the balance weight 7. When the recording drum 1 is rotated in a state where the adjusting pin 16 is inserted into the hole 7*a* of the balance weight 7, the end surface of the recording drum 1 is rotated and moved while sliding relative to the balance weight 7. Consequently, the position in the circumferential direction of the balance weight 7 on the end surface of the recording drum 1 is moved.

A controller 14 receives a detection signal from the rotation angle detector 13, and controls each of operations of the motor 12 for rotating the recording drum 1 and the pair of weight position adjusters 15.

An input unit 18 inputs information relating to the size, the weight, and so forth of the plate 2. A position calculator 19 calculates the position where the balance weight 7 is disposed on the basis of data representing the physical properties of the plate 2 which is inputted from the input unit 18. Further, a storage 20 stores the position where the balance weight 7 is disposed.

In the present embodiment, the recording drum 1 corresponds to a drum in the present invention, the driving mechanism corresponds to driving means, the movable clamp 5 corresponds to a fixing member, the balance weight 7 corresponds to a balance weight, and the annular groove 6 corresponds to an annular groove. Further, the position calculator 19 corresponds to position calculation means, the controller 14 corresponds to control means, the weight position adjuster 15 corresponds to engagement means, the storage 20 corresponds to storage means, and the input unit 18 corresponds to input means.

Description is now made of an operation for adjusting the positions of the balance weights 7 in the drawing apparatus. The operation for adjusting the positions of the balance weights 7 is performed by the step of calculating an unbalance force, the step of calculating the position where the balance weight is disposed, and the step of adjusting the position of the balance weight on the basis of control carried out by the controller 14.

When drawing processing of a new plate which differs in size and weight from the plate in preprocessing, information relating to the size, the weight, and so forth of the plate is previously inputted from the input unit 18. Thereafter, the following steps are carried out.

(1) Step of Calculating Unbalance Force

When the recording drum 1 is rotated at high speed, the fixing clamp 4, the movable clamp 5, the plate 2, and the fixing clamp balance member 8 which are disposed on the outer peripheral surface of the recording drum 1 respectively develop centrifugal forces directed outward along the radius of the recording drum 1 from the positions of their respective centers of gravity. Generally, the members are not arranged in consideration of a balance among the respective centrifugal forces. Therefore, an unbalance force is caused by variations in the directions in which the centrifugal forces are exerted and the sizes thereof. The direction in which the unbalance force is exerted periodically varies as the recording drum 1 is rotated. Therefore, forced vibration occurs in the rotary shaft 3 of the recording drum 1, causing the recording drum to develop a fault.

Therefore, the position calculator 19 calculates as follows the unbalance force exerted on the recording drum 1 on the basis of the inputted information relating to the size, the mass, and so forth of the plate 2 in addition to information relating to the position, the mass, and so forth of each of the members.

Figure 5A:
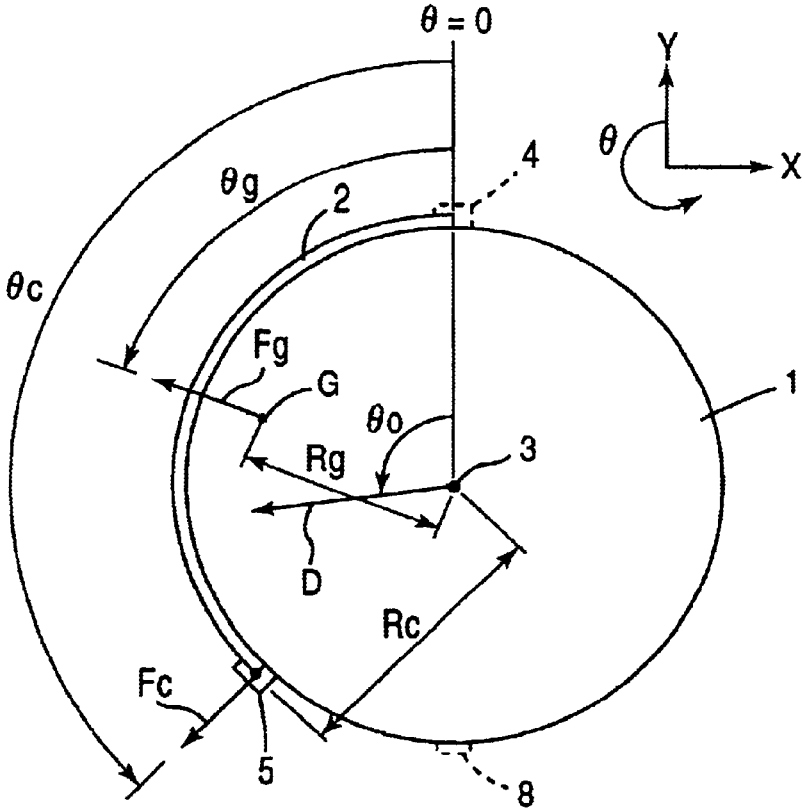
FIGS. 5(*a*) and 5(*b*) are schematic views showing an unbalance force caused by centrifugal forces developed by a movable clamp and a plate in the recording drum, and diagrams showing an unbalance force vector.
Figure 5B:
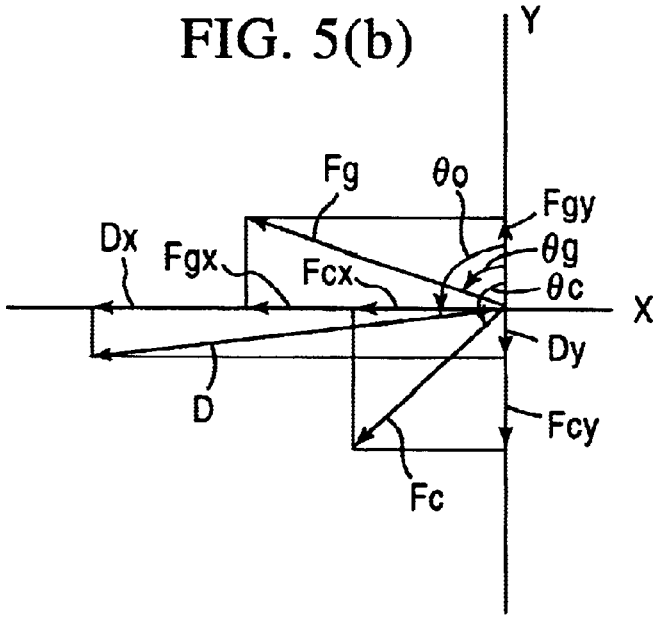

FIG. 5 is a schematic view (a) showing an unbalance force caused by the centrifugal forces developed by the movable clamp and the plate in the recording drum, and a diagram (b) of an unbalance force vector. In the following description, equations expressing the centrifugal force developed by the recording drum 1, the unbalance forces produced in the recording drum 1, and a balance force for canceling the unbalance force include a common term of rotation angular velocity.

In the following description, the common term of angular velocity is omitted. Consequently, the unbalance force and the balance force from which the term of angular velocity is omitted are respectively referred to as an unbalance amount D and a balance amount B.

The fixing clamp 4 and the fixing clamp balance member 8 are arranged such that their respective centrifugal forces are balanced with each other. Therefore, the fixing clamp 4 and the fixing clamp balance member 8 are excluded from the following calculation of the unbalance amount D.

Furthermore, in the following description, the rotary shaft 3 is taken as a center of rotation, and an X-Y coordinate system using as the Y-axis a direction passing through the center of rotation and the fixing clamp 4 and using as the X-axis a direction perpendicular to the Y-axis is fixed on the end surface of the recording drum 1. Further, the circumferential direction in a counterclockwise direction from the Y-axis is taken as a θ direction.

As shown in FIG. 5(*a*), when the recording drum 1 is rotated at high speed, the plate 2 develops a centrifugal force Fg in its center of gravity G. An angle in the circumferential direction of the centrifugal force Fg developed by the plate 2 is taken as θg.

The movable clamp 5 develops a centrifugal force Fc in its center of gravity. Let θc be an angle in the circumferential direction of the centrifugal force Fc developed by the movable clamp 5.

A composite amount of the centrifugal force Fg developed by the plate 2 and the centrifugal force Fc developed by the movable clamp 5 is exerted as the unbalance amount D on the rotary shaft 3 of the recording drum 1.

In FIG. 5(*b*), letting Dx and Dy be a component in the X-axis direction and a component in the Y-axis direction of the unbalance amount D, respectively, Dx and Dy are found by the following equations from the centrifugal forces Fg and Fc:

$$\begin{aligned} Dx &= Fgx + Fcx \\ &= Fg \cdot \sin\theta g + Fc \cdot \sin(\pi - \theta c) \\ &= Mg \cdot Rg \cdot \sin\theta g + Mc \cdot Rc \cdot \sin\theta c \end{aligned} \tag{1}$$

$$\begin{aligned} Dy &= Fgy + Fcy \\ &= Fg \cdot \cos\theta g + Fc \cdot \cos(\pi - \theta c) \\ &= Mg \cdot Rg \cdot \cos\theta + Mc \cdot Rc \cdot \cos\theta c \end{aligned} \tag{2}$$

Mg: mass of plate

Mc: mass of movable clamp

Rg: distance from rotary shaft to center of gravity G of plate

Rc: distance from rotary shaft to center of gravity of movable clamp

In the equations (1) and (2), Fgx and Fgy respectively indicate a component in the X-axis direction and a component in the Y-axis direction of the centrifugal force Fg, and Fcx and Fcy respectively indicate a component in the X-axis direction and a component in the Y-axis direction of the centrifugal force Fc.

Furthermore, letting $\theta_D$ be an angle in the circumferential direction in which the unbalance amount D is exerted, the unbalance amount D and the angle $\theta_D$ in the circumferential direction are respectively expressed by the following equations:

$$D = \sqrt{Dx^2 + Dy^2} \tag{3}$$

in case of Dx<0

$$\theta_D = \frac{\pi}{2} - \tan^{-1}\frac{Dy}{Dx} \tag{4}$$

in case of Dx≧0

$$\theta_D = \frac{3}{2}\pi + \tan^{-1}\frac{Dy}{Dx} \tag{5}$$

Consequently, the unbalance amount D and the direction in which the unbalance amount is exerted are found.

(2) Step of Calculating Position Where Balance Weight is Disposed

When the unbalance amount D and the direction in which the unbalance amount is exerted are found, the position calculator 19 calculates as follows such a balance amount B as to cancel the unbalance amount D.

Figure 6A:
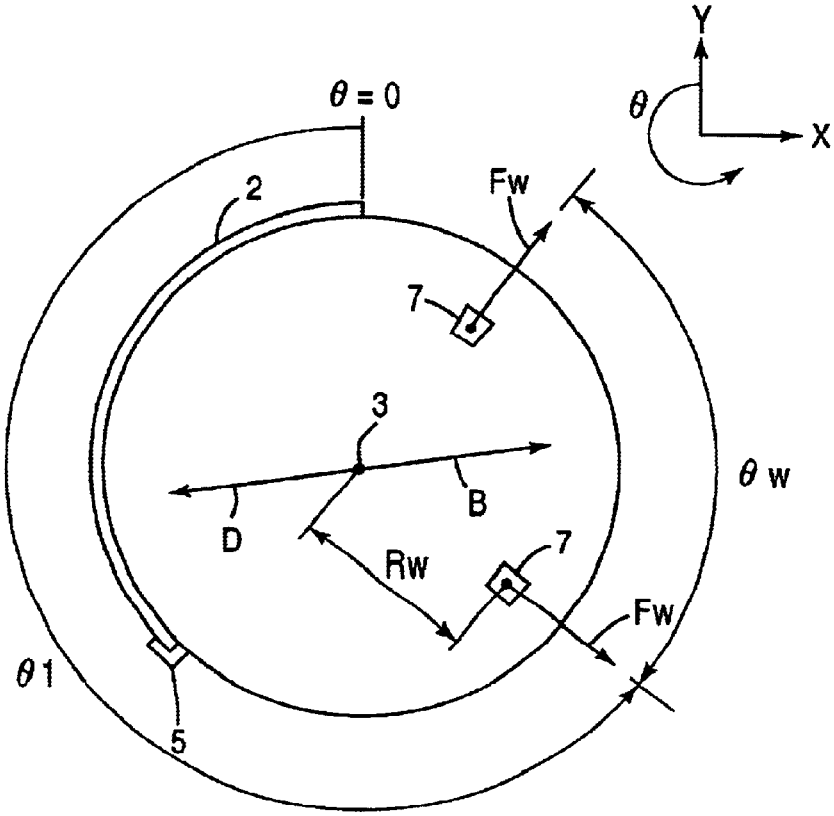
FIGS. 6(*a*) and 6(*b*) are schematic views showing a balance force caused by centrifugal forces developed by balance weights in the recording drum, and diagrams showing a balance force vector.
Figure 6B:
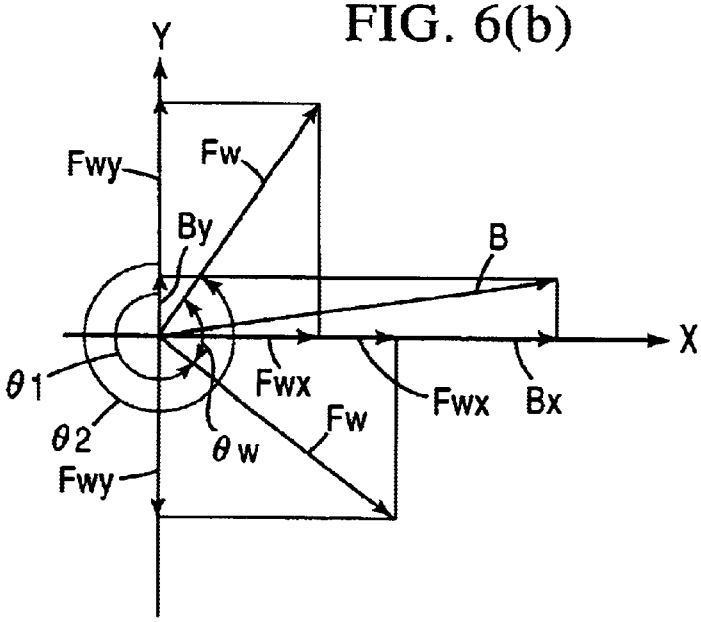

FIG. 6 is a schematic view (a) showing an unbalance force caused by centrifugal forces developed by the balance weights in the recording drum, and is a diagram (b) of a balance force vector. In FIG. 6(*a*), the balance amount B is so set as to be equal to the unbalance amount D, and to be exerted in the opposite direction to the unbalance amount D. The balance amount B is a composite amount of centrifugal forces Fw developed by two balance weights 7 on each of the end surfaces of the recording drum 1, that is, a composite amount of centrifugal forces Fw developed by four balance weights on both the end surfaces thereof. The mass of each of the balance weights 7 is previously determined. The distance Rw from the center of the rotary shaft 3 to the center of gravity of each of the balance weights 7 is defined by the annular groove 6.

The balance weights 7 are arranged symmetrically with each other on both the end surfaces of the recording drum 1. An angle θw between the two balance weights 7 is adjusted, to find a desired balance amount B. The two balance weights 7 shall be arranged upon being equally distributed on both sides in the direction in which the balance amount B is exerted.

Letting Mw be the mass of each of the balance weights 7, the centrifugal force Fw developed by the balance weight 7 is expressed by the following equation:

$$Fw = Mw \times Rw \tag{6}$$

A composite amount of the centrifugal forces Fw developed by the four balance weights 7 arranged on both the end surfaces of the recording drum 1, that is, the balance amount B is expressed by the following equation:

$$B = 4 \cdot Mw \cdot Rw \cdot \cos\frac{\theta_w}{2} \tag{7}$$

The balance amount B may be equal to the unbalance amount D previously found. The angle θw between the two balance weights 7 is found by the following equation on the basis of this relationship:

$$\theta_w = 2 \cdot \cos^{-1}\left(\frac{D}{4 \cdot Mw \cdot Rw}\right) \tag{8}$$

By the foregoing steps, respective angles (attaching angles) $\theta_1$ and $\theta_2$ in the circumferential direction from the Y-axis of one of the balance weights and the other balance weight on each of the end surfaces of the recording drum 1 are found by the following equation:

$$\theta_1 = \theta_D + \pi - \frac{\theta_w}{2} \tag{9}$$

$$\theta_2 = \theta_1 + \theta_w \tag{10}$$

(3) Step of Adjusting Position of Balance Weight

When the attaching angles $\theta_1$ and $\theta_2$ of the two balance weights 7 are found by the foregoing steps (1) and (2), the balance weights 7 are moved to positions at the found attaching angles.

In FIG. 1, the attaching angles $\theta_1$ and $\theta_2$ of the balance weights 7 on the end surface of the recording drum 1 at the time of terminating previous drawing processing are stored on the storage 20. The controller 14 drives the motor 12 on the basis of information relating to the current position where the recording drum 1 is rotated and information relating to the attaching angles of the balance weights 7 from the rotation angle detector 13, to rotate the recording drum 1 so that the adjusting pin 16 of the weight position adjuster 15 and the hole 7*a* of one of the balance weights 7 coincide with each other. The adjusting pin 16 is extended, and is inserted into the hole 7*a* of the balance weight 7. In this state, the recording drum 1 is rotated, to relatively move one of the balance weights 7 to the position at the attaching angle $\theta_1$ found in the above-mentioned step (2). Thereafter, the adjusting pin 16 is caused to retreat. Consequently, the adjustment of the position of one of the balance weights 7 is terminated.

The controller 14 then rotates the recording drum 1 so that the hole 7*a* of the other balance weight 7 coincides with the adjusting pin 16 of the weight position adjuster 15. The adjusting pin 16 is extended, and is inserted into the hole 7*a* of the balance weight 7. In this state, the recording drum 1 is rotated, to relatively move the other balance weight 7 to the position at the attaching angle $\theta_2$ found in the above-mentioned step (2). Thereafter, the adjusting pin 16 is caused to retreat. Consequently, the adjustment of the position of the other balance weight 7 is terminated.

By the foregoing steps, the four balance weights 7 are so disposed as to be balanced with the centrifugal forces developed by the plate 2 and the movable clamp 5. Consequently, the recording drum 1 can be rotated at high speed without causing forced vibration in the bearings of the rotary shaft 3.

Figure 7:
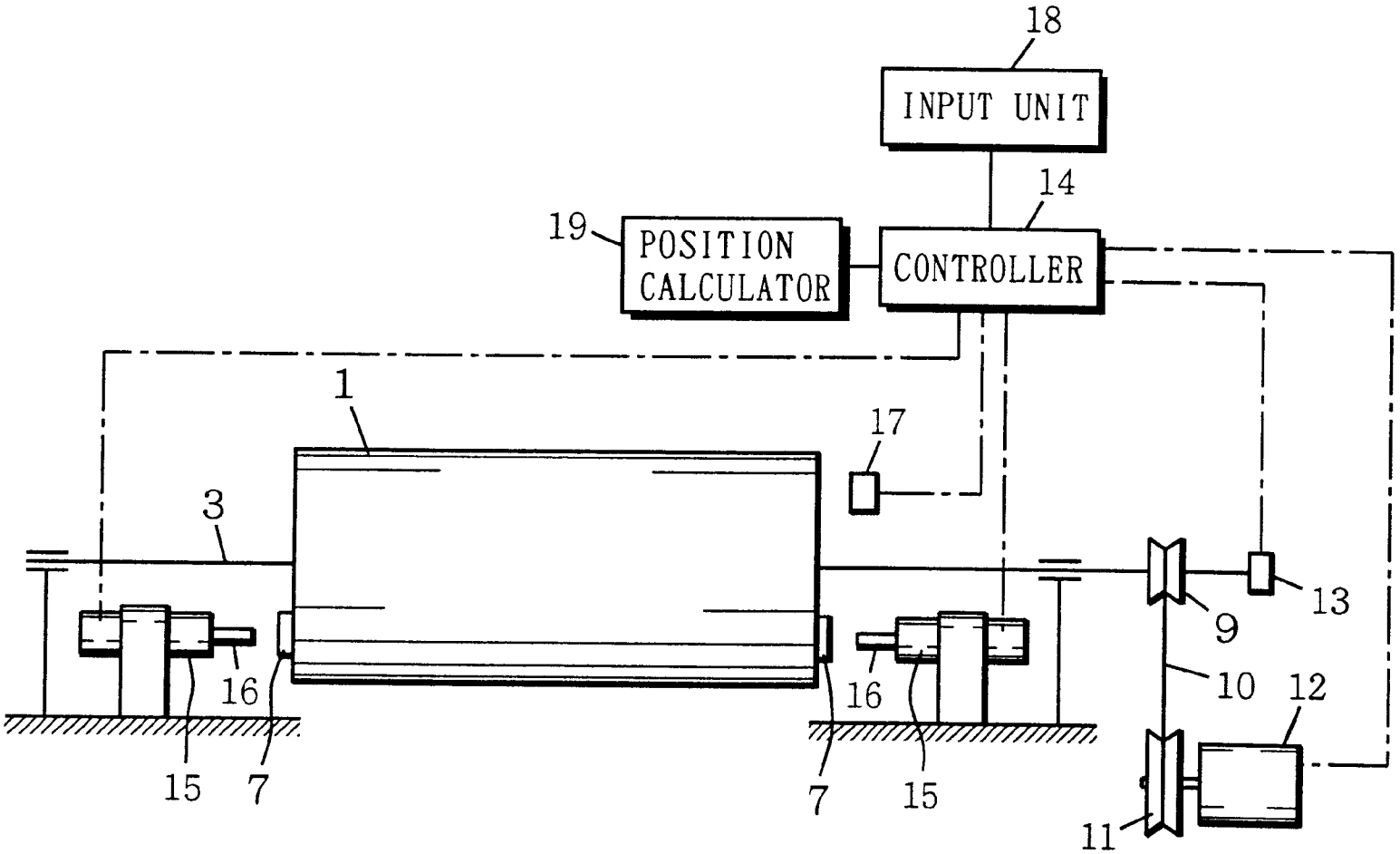
FIG. 7 is a schematic view of a drawing apparatus according to a second embodiment of the present invention.

FIG. 7 is a schematic view of a drawing apparatus according to a second embodiment of the present invention. In the drawing apparatus according to the second embodiment, a position detector 17 for detecting the position of a balance weight 7 is provided. Examples of the position detector 17 include an electrooptical sensor or a magnetic sensor.

The position detector 17 detects, at the step of adjusting the position where the balance weight 7 is disposed, the position of the balance weight 7 before position adjustment. A recording drum 1 is rotated such that an adjusting pin 16 of a weight position adjuster 15 and a hole 7*a* of the balance weight 7 coincide with each other on the basis of the detected position of the balance weight 7. Thereafter, the position of the balance weight 7 is adjusted by the same operations as those in the first embodiment.

The position detector 17 is thus provided, to eliminate the necessity of providing a storage for storing the position of the balance weight 7 for each drawing processing on a plate 2, so that the construction of the drawing apparatus is simplified.

In the present embodiment, the position detector 17 corresponds to detection means in the present invention.

Figure 8:
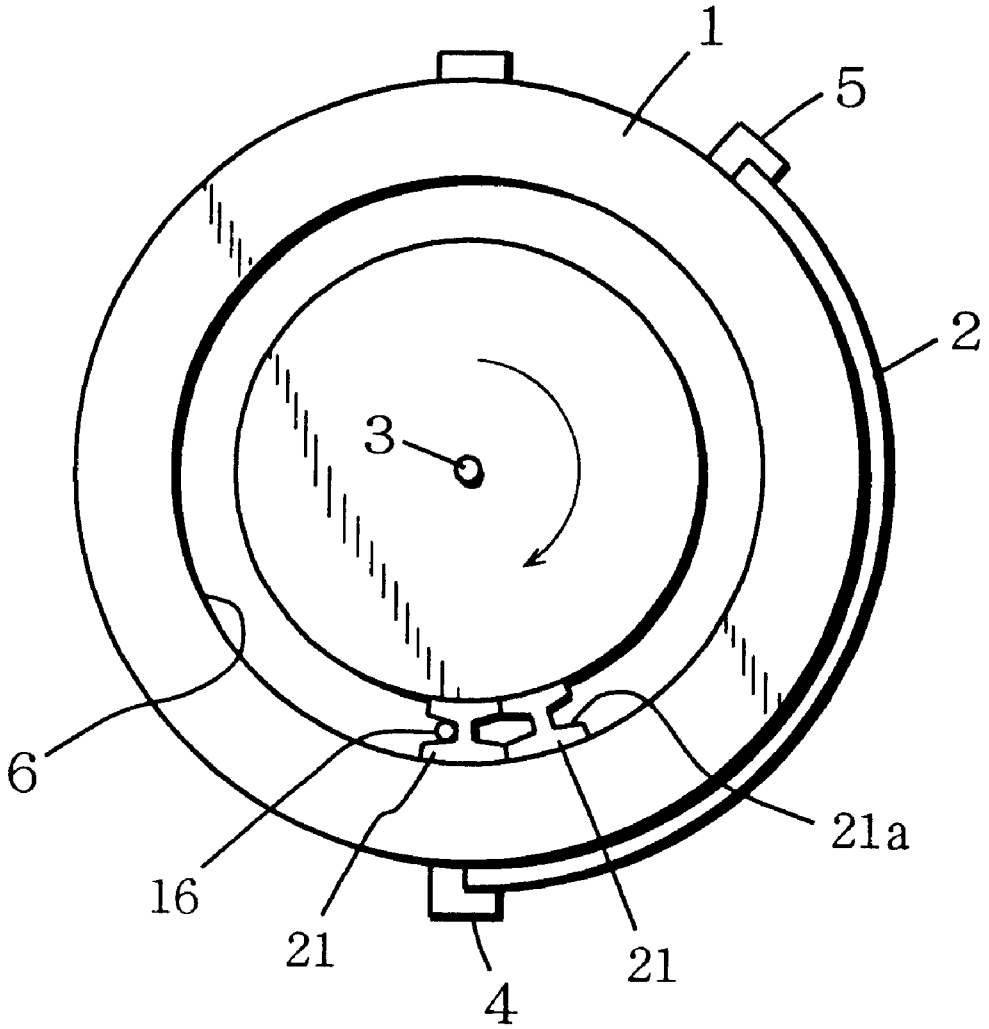
FIG. 8 is a schematic side view of a recording drum in a drawing apparatus according to a third embodiment of the present invention.

FIG. 8 is a schematic side view of a recording drum in a drawing apparatus according to a third embodiment of the present invention. The drawing apparatus according to the third embodiment differs from the drawing apparatuses according to the first and second embodiments in a balance weight position adjusting operation. In the drawing apparatus according to the third embodiment, a balance weight can be moved to a predetermined position in the following manner without storing the position where the balance weight is attached and provision means for detecting the position of the balance weight.

In FIG. 8, balance weights 21 are arranged inside an annular groove 6, and a tapered notch 21*a* is formed on an end surface in the circumferential direction of each of the balance weights 21. The notch 21*a* guides an adjusting pin 16 of a weight position adjuster 15 such that the adjusting pin 16 always abuts against a predetermined position of the balance weight 21.

When an attaching angle of the balance weight is calculated by a position calculator 19 as in the above-mentioned first and second embodiments, the program proceeds to a position adjusting step. At the step, the adjusting pin 16 of the weight position adjuster 15 is first extended into the annular groove 6. The recording drum 1 is rotated at least once, and is then stopped such that a fixing clamp 4 of the recording drum 1 is at the position of the origin in the direction of rotation. Consequently, the two balance weights 21 are aligned in the position of the origin in the direction of rotation by the adjusting pin 16 on each of the end surfaces of the recording drum 1, as shown in FIG. 8.

The recording drum 1 is then moved, to insert the adjusting pin 16 into the notch 21*a* between the two balance weights 21. The recording drum 1 is rotated such that the adjusting pin 16 abuts against one of the balance weights 21, to move one of the balance weights 21 to a position at an attaching angle $\theta_1$ inside the annular groove 6 of the recording drum 1. Consequently, the adjustment of the position of one of the balance weights 21 is terminated.

In the same manner as described above, the recording drum 1 is rotated such that the adjusting pin 16 abuts against the other balance weight 21, to move the other balance weight 21 to a position at an attaching angle $\theta_2$. Consequently, the adjustment of the position of the other balance weight 21 is terminated. In the present embodiment, the balance weight 21 can be thus moved to a predetermined position where the balance weight 21 is attached without previously storing and detecting the position of the balance weight 21.

Although the drawing apparatuses according to the first to third embodiments are so constructed as to adjust the positions of the balance weights 7 or 21 using the weight position adjuster 15, a worker may find the positions where the balance weights 7 or 21 are disposed and then directly attach the balance weights 7 or 21 to the positions on both the end surfaces of the recording drum 1. In this case, the necessity of the weight position adjuster 15 is eliminated, so that the construction of the drawing apparatus is simplified.

Although in the above-mentioned first to third embodiments, description was made of an example in which the two balance weights 7 or the two balance weights 21 are arranged on each of the end surfaces of the recording drum 1, the present invention is not limited to the same. For example, at least two balance weights 7 or 21 may be arranged per end surface. By increasing the number of the balance weights 7 or 21, the size of each of the balance weights can be decreased. Therefore, arrangement becomes easy, and fine adjustment becomes easy.

Although in the above-mentioned first to third embodiments, the balance weights 7 or 21 are disposed inside the annular grooves 6, they may be directly attached to the end surfaces of the recording drum 1 without providing the annular grooves 6.

Furthermore, the balance weight 7 or 21 is not limited to a magnet. For example, the balance weight may have a structure in which it is mechanically attached to the end surface of the recording drum 1.

Figure 9:
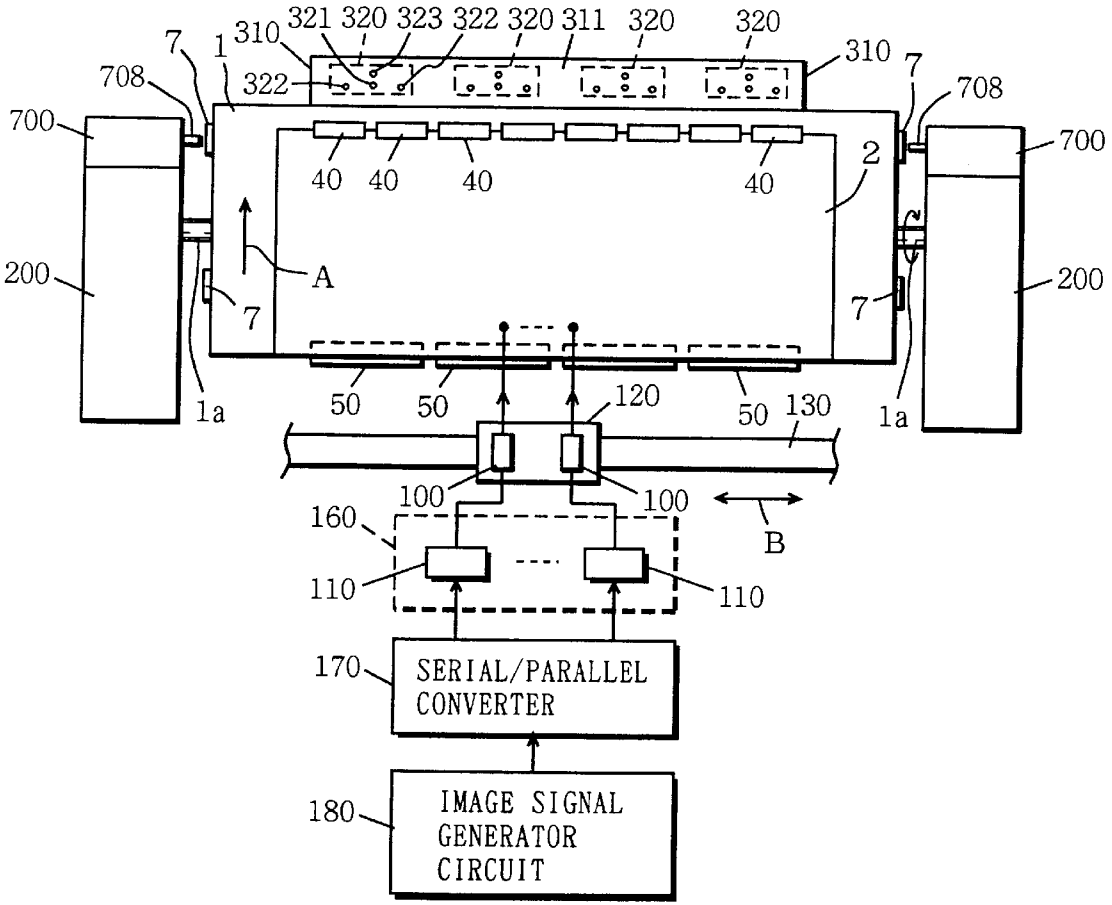
FIG. 9 is a schematic front view of a drawing apparatus in the fourth embodiment of the present invention.
Figure 10:
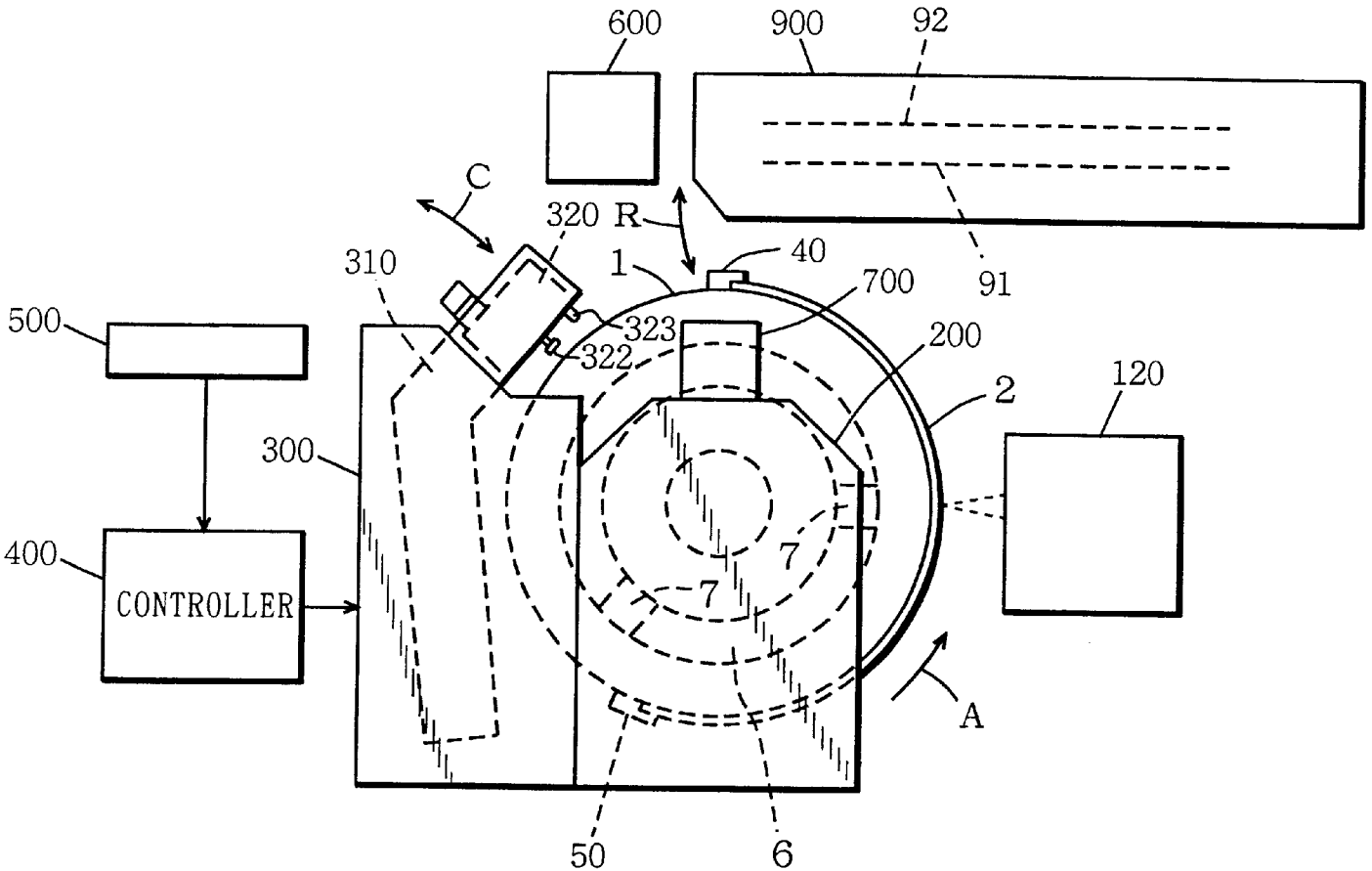
FIG. 10 is a schematic side view of the drawing apparatus shown in FIG. 9.

FIG. 9 is a schematic side view of a drawing apparatus according to a fourth embodiment of the present invention, and FIG. 10 is a schematic side view of the drawing apparatus shown in FIG. 9.

In FIGS. 9 and 10, the drawing apparatus comprises a cylindrical recording drum 1. The recording drum 1 is rotated in a direction indicated by an arrow A (a primary scanning direction) around a rotary shaft la by a rotation driving device 200. The rotation driving device 200 comprises a servo motor for applying a driving force to the rotary shaft 10 of the recording drum 1 and an encoder for detecting the amount of rotation of the recording drum 1.

A plate 2 made of aluminum is mounted as a photosensitive material on an outer peripheral surface of the recording drum 1. One end of the plate 2 is fixed to the outer peripheral surface of the recording drum 1 by a plurality of front end clamps 40, and the other end of the plate 2 is fixed to the outer peripheral surface of the recording drum 1 by a plurality of rear end clamps 50. The plurality of front end clamps 40 correspond to the fixing clamp 4 in the first embodiment, and the plurality of rear end clamps 50 correspond to the movable clamp 5 in the first embodiment.

As shown in FIG. 10, annular grooves 6 are respectively formed on both end surfaces of the recording drum 1, and two balance weights 7 are attached so as to be movable in the circumferential direction inside each of the annular grooves 6. A weight position adjuster 700 for moving the balance weights 7 is arranged on a rotation driving device 200.

As shown in FIG. 9, a recording head 120 comprising a plurality of laser diodes 100 is disposed ahead of the recording drum 1. The structures and the operations of the recording head 120, a laser diode driving circuit portions 160, a serial/parallel converter 170, and an image signal generator circuit 180 are the same as the structures and the operations of the corresponding units in the drawing apparatus shown in FIG. 2.

As shown in FIG. 10, a clamp driving device 300 is provided behind the recording drum 1. The clamp driving device 300 is used for attaching the rear end clamps 50 on the recording drum 1, detaching the rear end clamps 50 from the recording drum 1, and releasing the front end clamps 40 on the recording drum 1.

The clamp driving device 300 comprises a pair of clamp arms 310 which are swingable in a direction indicated by an arrow C. As shown in FIG. 9, a driving bar 311 is attached between the pair of clamp arms 310, and a plurality of first driving devices 320 are attached to the driving bar 311. The first driving device 320 is provided with a driving pin 321 for fixing and releasing the rear end clamps 50, two holding pins 322 for holding the rear end clamps 50, and a release pin 323 for releasing the front end clamps 40 at the time of attaching the plate 2. The clamp driving apparatus 300 comprises a second driving device (not shown) for releasing the front end clamps 40 at the time of detaching the plate 2.

As shown in FIG. 10, a conveying unit 900 is disposed so as to be swingable in a direction indicted by an arrow R above the recording drum 1. The conveying unit 900 comprises a first plate carry-in conveying path 91 and a second plate carry-out conveying path 92. At the time of carrying the plate 2 into the recording drum 1, the plate 2 is supplied onto the recording drum 1 through the first conveying path 91 in the conveying unit 900. At the time of carrying the plate 2 out of the recording drum 1, the plate 2 detached from the recording drum 1 is carried outward through the second conveying path 92 in the conveying unit 900.

A punching device 600 for punching a positioning hole in the plate 2 is disposed at a front end of the conveying unit 900. The plate 2 is supplied to the punching device 600 through the first conveying path 91 in the conveying unit 900 before being supplied onto the recording drum 1, so that the positioning hole is formed at a front end of the plate 2. The positioning hole in the plate 2 is engaged with a positioning pin (not shown) provided on the outer peripheral surface of the recording drum 1.

A controller 400 shown in FIG. 10 comprises a CPU (Central Processing Unit), a storage device, an input-output interface, and so forth, and controls the respective units of the drawing apparatus. An operation panel 500 for a worker entering various type of information relating to the size of the plate 2, for example, and various types of instructions is connected to the controller 400.

Figure 11:
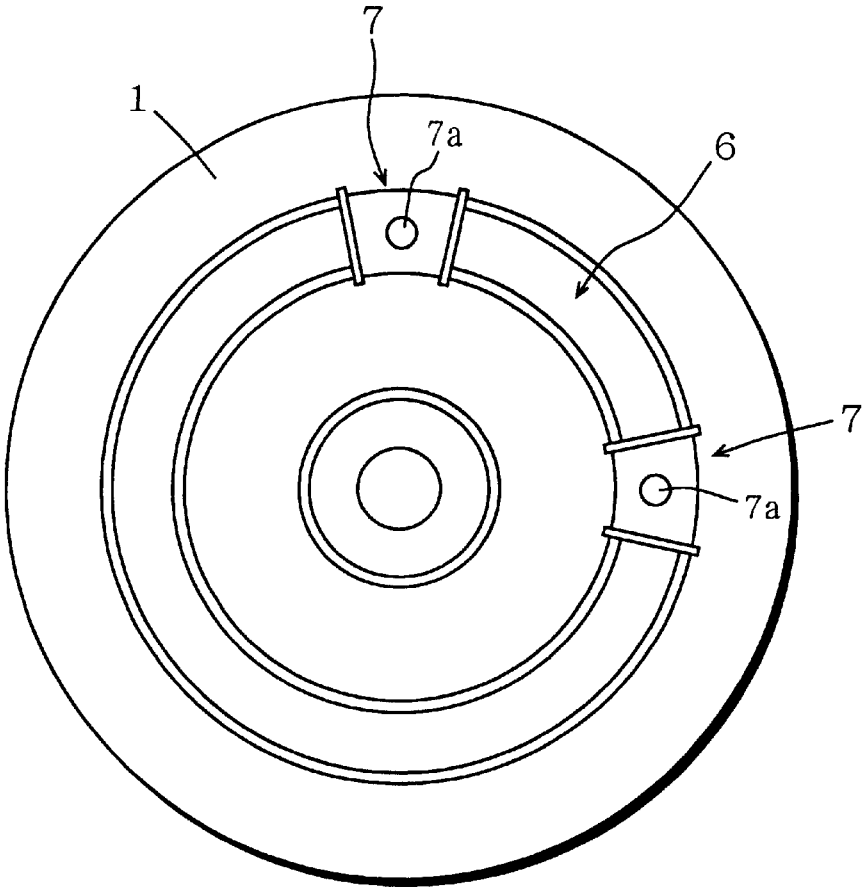
FIG. 11 is a front view showing one end of a recording drum shown in FIGS. 9 and 10.

FIG. 11 is a side view showing one of end surfaces of the recording drum 1. As shown in FIG. 11, an annular grove 6 is formed on the end surface of the recording drum 1. Two balance weights 7 each having a hole 7*a* are attached in the annular groove 6 so as to be movable in the circumferential direction.

Figure 12:
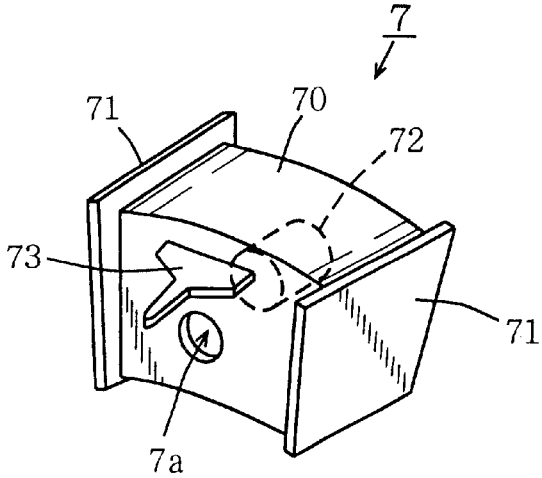
FIG. 12 is a perspective view of a balance weight used for the drawing apparatus shown in FIGS. 9 and 10.

FIG. 12 is a perspective view of the balance weight 7. As shown in FIG. 12, the balance weight 7 comprises a weight main body 70 and a pair of resin plates 71. The resin plates 71 are respectively attached to both side surfaces of the weight main body 70. The balance weight 7 slides on an end surface of the resin plate 71 inside the annular groove 6 of the recording drum 1. The weight main body 70 contains a magnet 72. Further, a position detecting dog 73 projecting perpendicularly to a surface, on which the hole 7*a* is formed, of the weight main body 70 is attached.

FIG. 13 is a front view showing the structure and the operation of a weight position adjuster 700.

In FIG. 13, aluminum is used as the material of the recording drum 1 in order to make the recording drum 1 lightweight. A thin metal plate 6*a* is screwed to a bottom surface of the annular groove 6 in the recording drum 1. The magnet 72 contained in the balance weight 7 attracts the metal plate 6*a*, so that the balance weight 7 is fixed in the annular groove 6.

The weight position adjuster 700 comprises a driving device main body 701. The driving device main body 70 is provided with a cam driving motor 702. A cam 703 is attached to the cam driving motor 702. A driving plate 704 is attached to the driving device main body 701 so as to be rotatable around a rotary shaft 705. One end of the driving plate 704 is urged in a direction indicated by an arrow S1 by a spring 706. A U-shaped notch 707 is formed at the other end of the driving plate 704.

A driving pin 708 is attached to the driving device main body 701 so as to be slidable in the horizontal direction by an attaching member 709. An engaging pin 710 which is engaged with the U-shaped notch 707 of the driving plate 704 is provided at a rear end of the driving pin 708.

A reflection type balance weight detecting sensor 711 for detecting the position detecting dog 73 of the balance weight 7 is attached to a front surface of the driving device main body 701. A reflection type driving plate detecting sensor 712 for detecting the driving plate 704 is attached to an upper surface of the driving device main body 701.

As shown in FIG. 13(*a*), the driving plate 704 is urged in a direction indicated by the arrow S1 by the spring 760 in its initial state. Consequently, the driving pin 708 is spaced apart from an end surface of the recording drum 1. At this time, one end of the driving plate 704 is detected by the driving plate detecting sensor 712.

The balance weight 7 in the annular groove 6 of the recording drum 1 is detected by the balance weight detecting sensor 711. As shown in FIG. 13(*b*), the cam 703 is rotated through a predetermined angle by the cam driving motor 702 at the time of driving the balance weight 7. Consequently, the driving plate 704 is rotated in a direction indicated by an arrow S2 against an urging force of the spring 706. As a result, the driving pin 708 is pressed out toward the end surface of the recording drum 1, and is inserted into the hole 7*a* of the balance weight 7.

By rotating the recording drum 1 in this state, the balance weight 7 can be moved in the circumferential direction in the annular groove 6 of the recording drum 1.

Thereafter, when the cam 703 is returned to the initial state by the cam driving motor 702, the driving plate 704 is rotated in the direction indicated by the arrow S1 by the urging force of the spring 706. Consequently, the driving pin 708 retreats, and is detached from the hole 7*a* of the balance weight 7. The balance weight 7 is fixed in the annular groove 6 by a magnetic force of the magnet 72.

Figure 14:
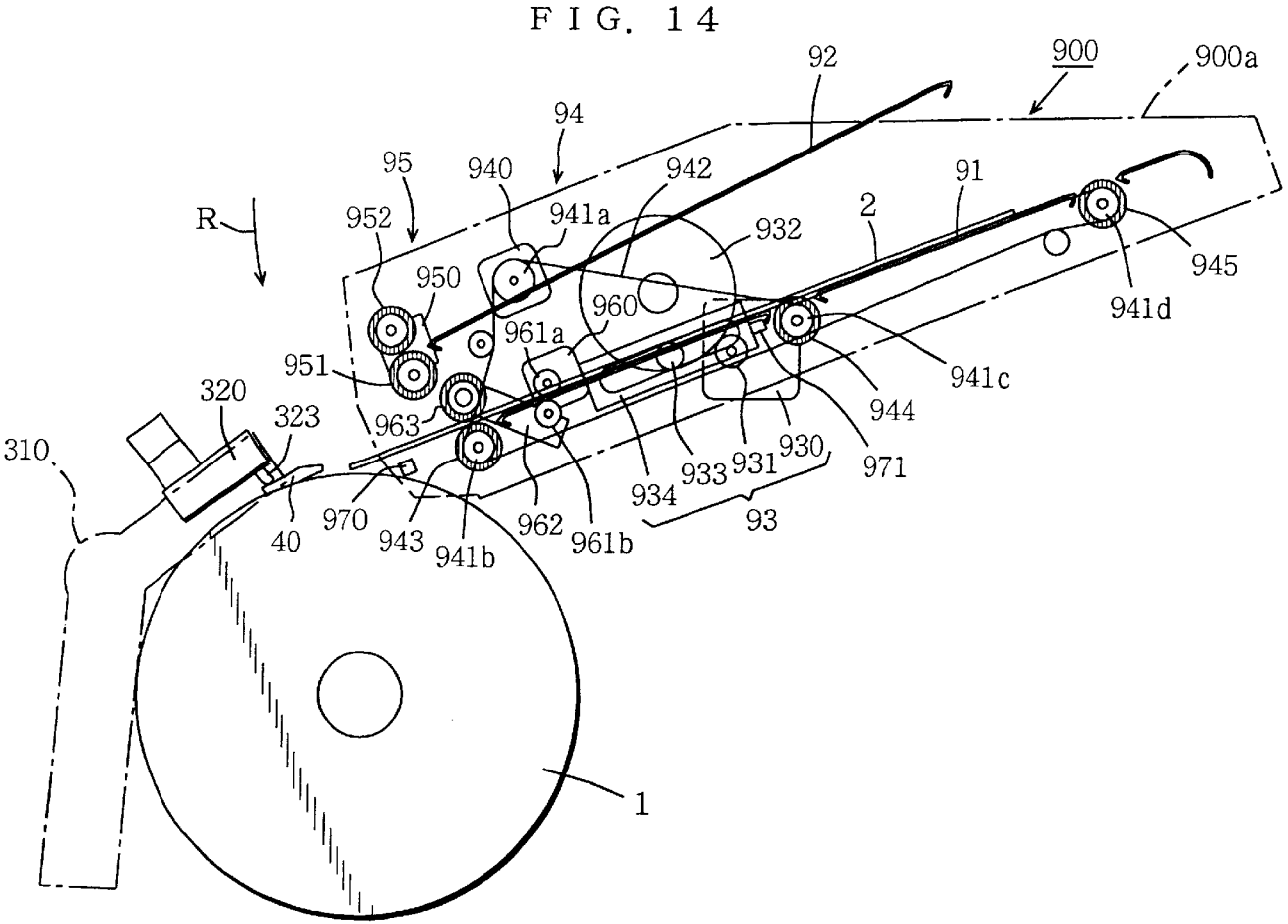
FIG. 14 is a side view showing the structure and the operation of a conveying unit shown in FIG. 10.

FIG. 14 is a side view showing the structure of the conveying unit 900.

The conveying unit 900 comprises the first plate carry-in conveying path 91, the second plate carry-out conveying path 92, a conveying path switching mechanism 93, a first conveying mechanism 94, and a second conveying mechanism 95 inside a unit main body 900*a*.

The conveying path switching mechanism 93 is constituted by a conveying path switching motor 930, a gear 931, a cam gear 932, a cam follower 933, and a cam follower guide 934. The gear 931 is attached to the conveying path switching motor 930, the cam gear 932 is meshed with the gear 931, and the cam follower 933 is fixed to the cam gear 932. The cam follower 933 is engaged with the cam follower guide 934. The cam follower guide 934 is fixed to the unit main body 900*a*, and the unit main body 900*a* is supported so as to be swingable by a predetermined supporting member (not shown), centered around its rear part.

When the conveying path switching motor 930 is rotated, the cam gear 932 is rotated through the gear 931, and the cam follower guide 934 is moved up and down by the cam follower 933 fixed to the cam gear 934. Consequently, the conveying unit 900 swings in a direction indicated by an arrow R.

The first conveying mechanism 94 is constituted by a conveying roller driving motor 940, pulleys 941*a*, 941*b*, 941*c* and 941*d*, a belt 942, and three conveying rollers 943, 944, and 945. The pulley 941*a* is attached to the conveying roller driving motor 940, and the pulleys 941*b*, 941*c*, and 941*d* are respectively attached to the conveying rollers 943, 944, and 945. Torque developed by the conveying roller driving motor 940 is transmitted to the pulleys 941*b*, 941*c*, and 941*d* through the belt 942 from the pulley 941*a*. Consequently, the conveying rollers 943, 944, and 945 are rotated.

The second conveying mechanism 95 is constituted by a conveying roller driving motor 950 and conveying rollers 951 and 952. The conveying rollers 951 and 952 are rotated by the conveying roller driving motor 950.

A nip roller 963 is disposed in close proximity to the conveying roller 943 in the first conveying path 91. The nip roller 963 is supported so as to be swingable by a swinging member 962. A gear 961*a* is attached to a nip roller driving motor 960. The gear 961*a* is meshed with a gear 961*b* attached to the swinging member 962. When the nip roller driving motor 960 is rotated, the swinging member 962 swings through the gears 961*a* and 961*b*, and the nip roller 963 is brought into contact with the conveying roller 943. Consequently, the plate 2 is held by the conveying roller 943 and the nip roller 963.

A plate front end detecting sensor 970 for detecting a front end of the plate 2 is disposed at a front end of the first conveying path 91, and a plate rear end detecting sensor 971 for detecting a rear end of the plate 2 is disposed at the center of the first conveying path 91.

Figure 15:
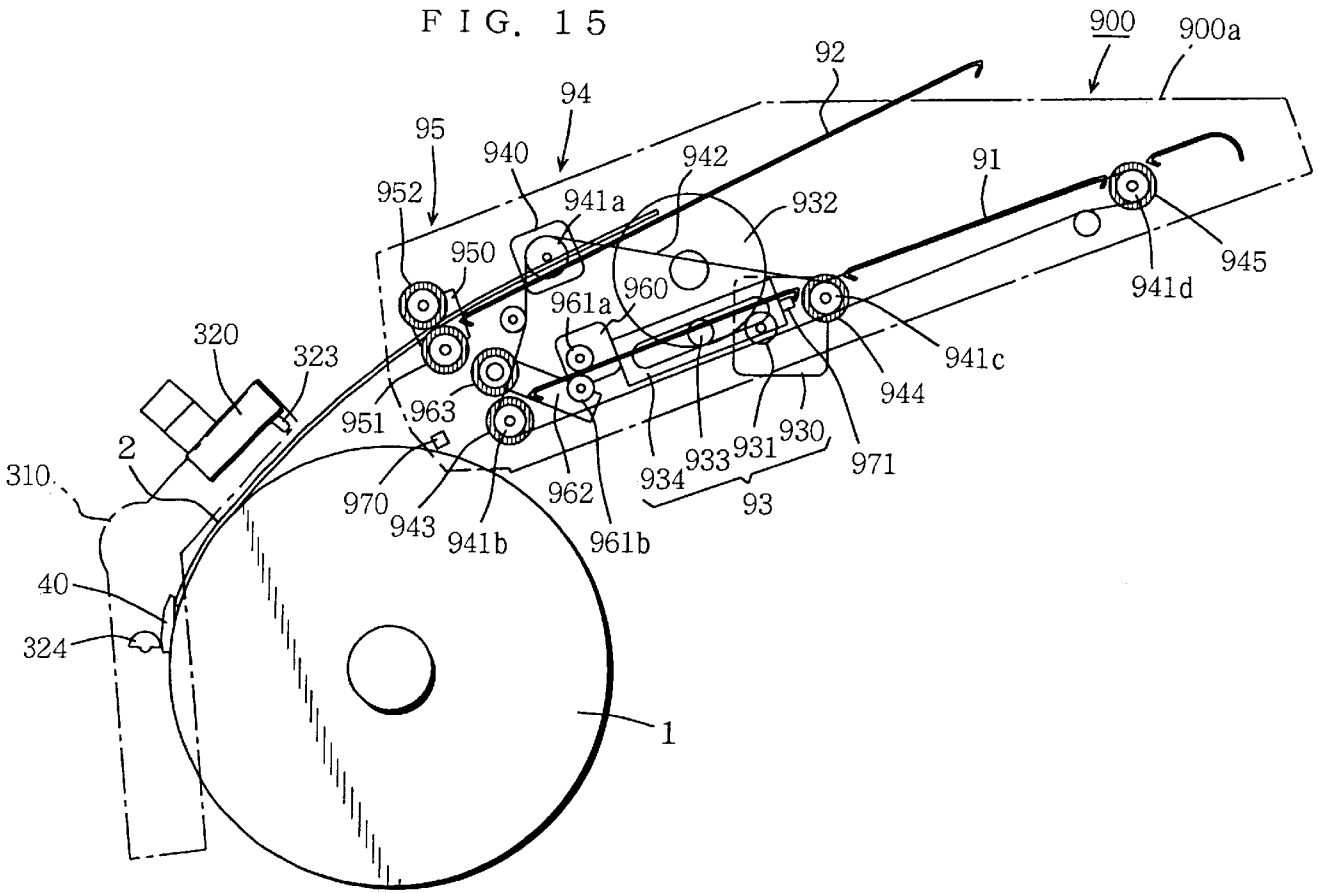
FIG. 15 is a side view showing the structure and the operation of the conveying unit shown in FIG. 10.

The operations of the conveying unit 900 will be described while referring to FIGS. 14 and 15.

When the plate 2 is carried into the recording drum 1, the plate 2 is set on the first conveying path 91 in the conveying unit 900, and a positioning hole is formed at the front end of the plate 2 by the punching device 600 shown in FIG. 10, after which the conveying unit 900 is swung toward its lower position by the conveying path switching motor 930, as shown in FIG. 14. The nip roller 963 is spaced apart from the conveying roller 943 by the nip roller driving motor 960.

A clamp arm 310 is swung, to bring the first driving device 320 near the outer peripheral surface of the recording drum 1, and press a rear end of the front end clamp 40 by the release pin 323 of the first driving device 320. Consequently, a clearance is formed between the front end of the front end clamp 40 and the outer peripheral surface of the recording drum 1.

In this state, the conveying roller driving motor 940 is rotated, the plate 2 is conveyed toward the recording drum 1, the front end of the plate 2 is inserted between the front end of the front end clamp 40 and the outer peripheral surface of the recording drum 1, and the positioning hole of the plate 2 is fitted in the positioning pin on the recording drum 1.

After the conveying roller driving motor 940 is stopped, the clamp arm 310 is returned in the opposite direction, to separate the release pin 323 of the first driving device 320 from the front end clamp 40. Consequently, the front end of the plate 2 is fixed to the outer peripheral surface of the recording drum 1 by the front end clamp 40.

Thereafter, the conveying roller driving motor 940 is rotated, the recording drum 1 is rotated, and the plate 2 is wound around the outer peripheral surface of the recording drum 1, after which the rear end of the plate 2 is fixed to the outer peripheral surface of the recording drum 1 by the rear end clamp 50, as shown in FIG. 10.

When the plate 2 is carried out of the recording drum 1, the rear end clamp 50 is released by the first driving device 320 in the clamp driving device 300, and the recording drum 1 is then rotated in the opposite direction. As shown in FIG. 15, the front end of the plate 2 is inserted between the conveying rollers 951 and 952 in the second conveying mechanism 95 in the conveying unit 900, and the conveying rollers 951 and 952 are rotated by the conveying roller driving motor 950, to pull the plate 2 into the second conveying path 92 in the conveying unit 900. Thereafter, the front end clamp 40 on the recording drum 1 is released by a second driving device 324 in the clamp driving device 300, to carry the plate 2 outward through the second conveying path 92 in the conveying unit 900.

Figure 16:
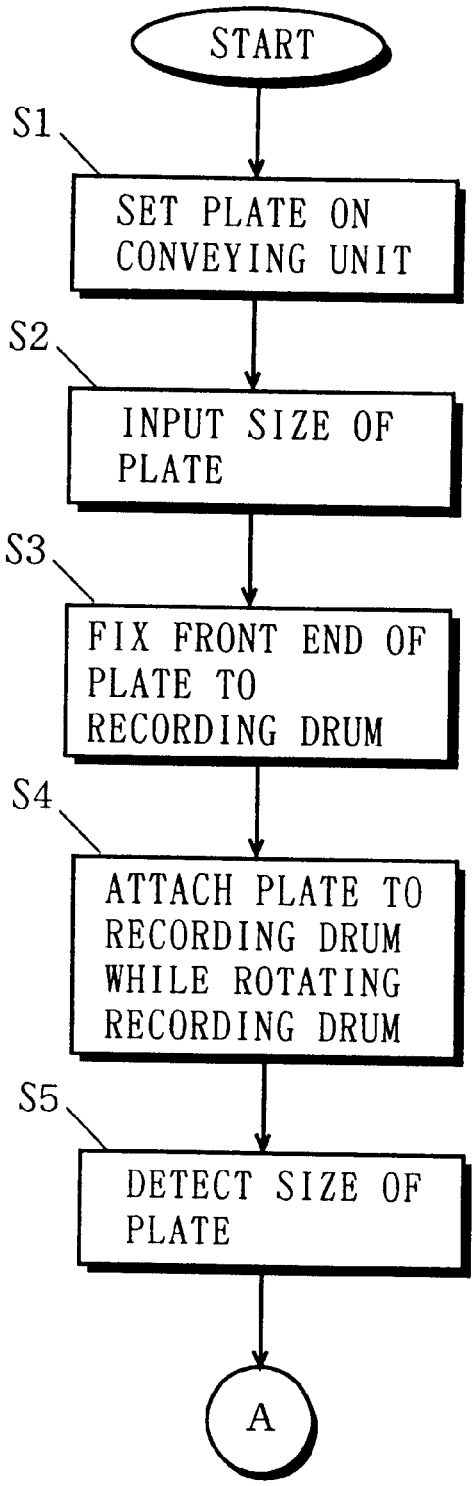
FIG. 16 is a flow chart showing an example of operations of the drawing apparatus shown in FIGS. 9 and 10.
Figure 17:
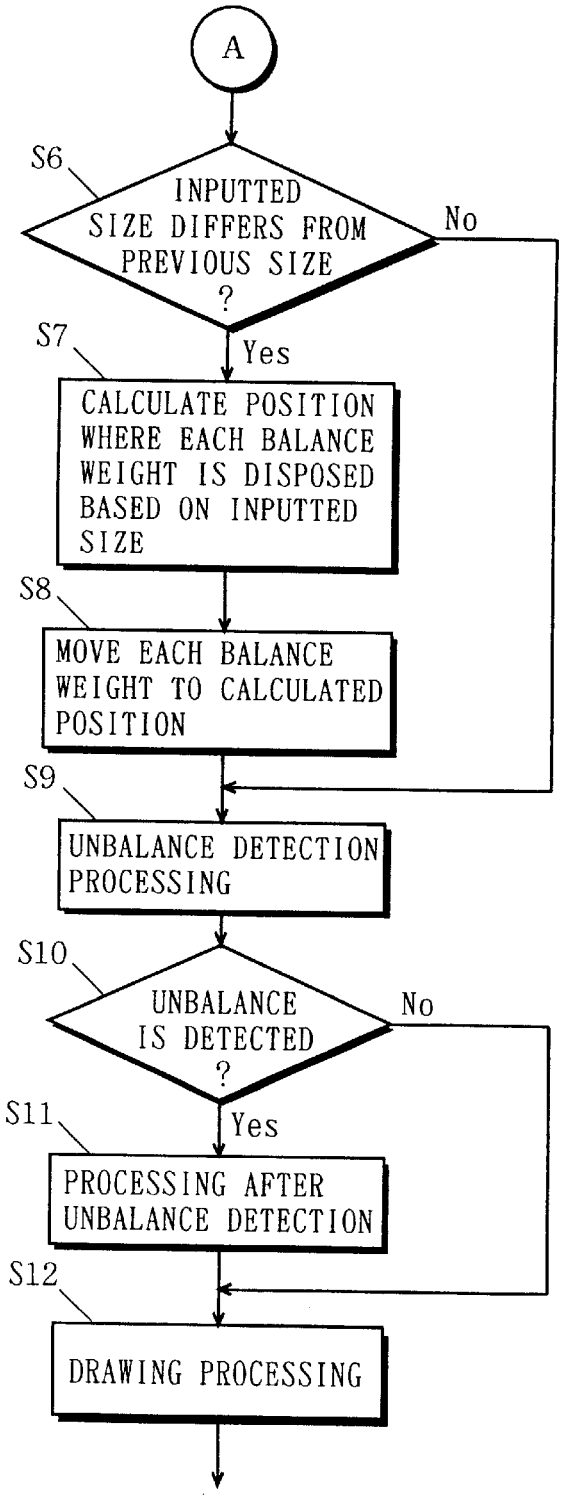
FIG. 17 is a flow chart showing an example of operations of the drawing apparatus shown in FIGS. 9 and 10.

FIGS. 16 and 17 are flow charts showing an example of operations of the drawing apparatus shown in FIGS. 9 and 10.

The controller 400 shown in FIG. 10 stores the current position of each of the balance weights 7 on the end surface of the recording drum 1 and the size of the precious plate.

A worker sets the plate 2 on the first conveying path 91 in the conveying unit 9 shown in FIG. 10 (step S1), and enters the size of the plate 2 from the operation panel 500 (step S2).

As shown in FIG. 14, the conveying unit 900 is then swung downward, and the plate 2 is conveyed onto the recording drum 1 through the conveying path 91, to fix the front end of the plate 2 to the outer peripheral surface of the recording drum 1 by the front end clamp 40 (step S3).

Thereafter, the plate 2 is mounted on the outer peripheral surface of the recording drum 1 while rotating the recording drum 1 (step S4). At this time, the controller 400 detects the size of the plate 2 on the basis of the timing at which the front end of the plate 2 passes through the plate front end detecting sensor 970 shown in FIG. 14, the timing at which the rear end of the plate 2 passes through the plate rear end detecting sensor 971, and the transport speed of the plate 2 (step S5).

The controller 400 then judges whether or not the size of the plate 2 inputted from the operation panel 500 differs from the size of the previous plate (step S6).

When the size of the plate 2 inputted from the operation panel 500 differs from the size of the previous plate, the controller 400 calculates the position where each of the balance weights 7 is disposed on the basis of the size of the plate 2 inputted from the operation panel 500 (step S7). A method of calculating the position where each of the balance weights 7 is disposed is the same as that in the first embodiment.

Each of the balance weights 7 attached to both end surfaces of the recording drum 1 is moved to the calculated position where it is disposed by the weight position adjuster 700 (step S8). In this case, the controller 400 stores the current position of each of the balance weights 7. Therefore, the recording drum 1 is first rotated, to move one of the balance weights 7 to the position of the driving pin 708 in the weight position adjuster 700. As shown in FIG. 13, the driving pin 708 in the weight position adjuster 700 is inserted into the hole 7*a* of the balance weight 7. In this state, the recording drum 1 is rotated, to move the balance weight 7 to the calculated position where it is disposed. Similarly, the other balance weight 7 is moved to the calculated position where it is disposed by the weight position adjuster 700.

Unbalance detection processing, described later, is then performed (step S9). When the size of the plate 2 inputted from the operation panel 500 is the same as the size of the previous plate at the step S6, the unbalance detection processing is performed without calculating the position where each of the balance weights 7 is disposed (step S7) and moving the balance weight 7 (step S8).

When the unbalance of the recording drum 1 is detected (step S10), the controller 400 performs processing after unbalance detection, as described later (step S11). Thereafter, drawing processing is performed by the recording head 120 shown in FIGS. 9 and 10 (step S12).

According to the above-mentioned operations of the drawing apparatus in the present embodiment, the unbalance of the recording drum 1 is automatically detected, so that an unbalance is prevented from occurring in the recording drum 1 by an input error of the size of the plate 2 by the worker. Consequently, the drawing apparatus is prevented from being damaged by forced vibration in the recording drum 1.

Figure 18:
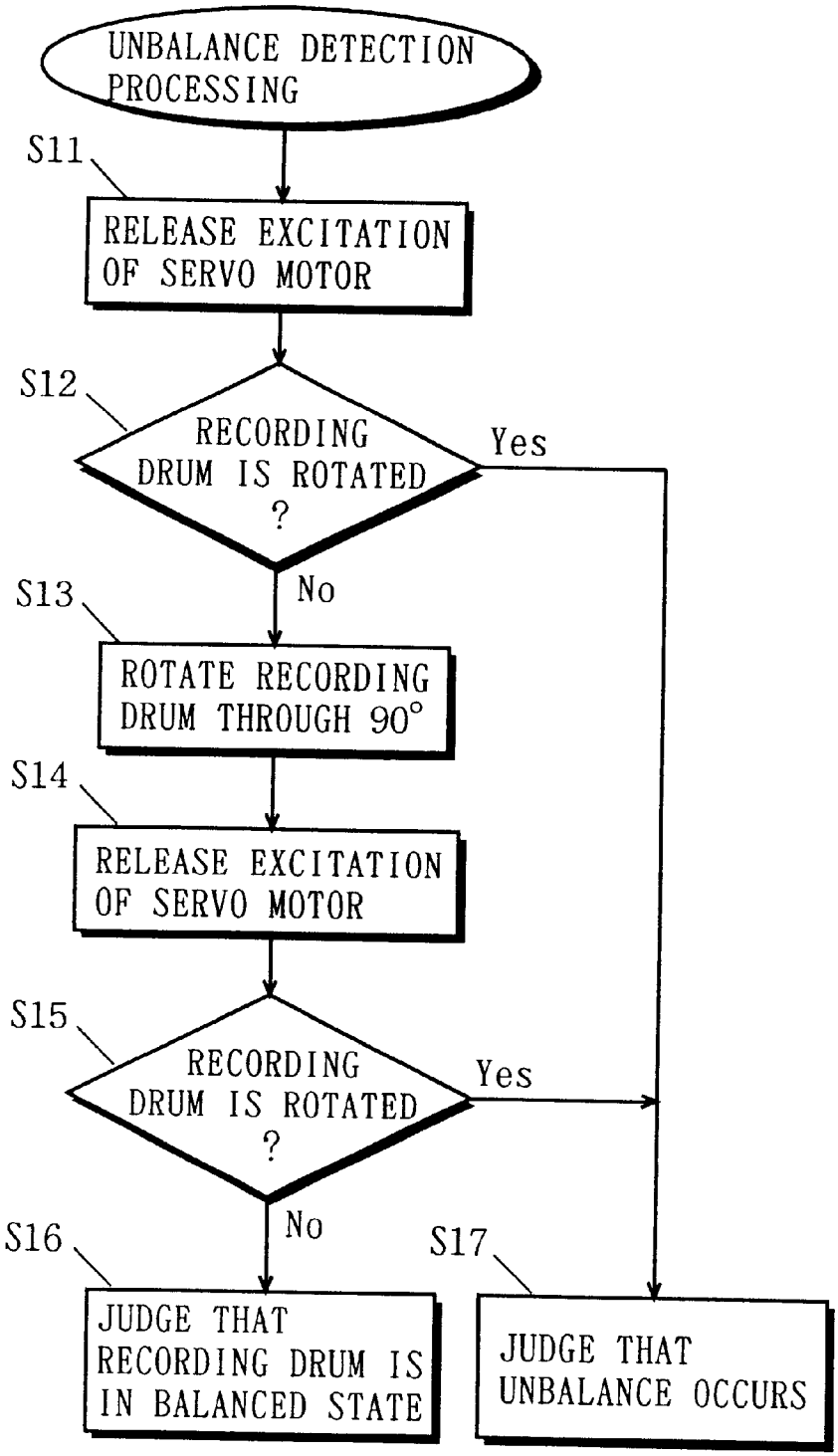
FIG. 18 is a flow chart showing unbalance detection processing.

FIG. 18 is a flow chart showing the unbalance detection processing.

The excitation of a servo motor included in the rotation driving device 200 is first released, to bring the recording drum 1 into a free state (step S11). At this time, if an unbalance occurs in the recording drum 1, the recording drum 1 is subtly rotated. An output pulse of the encoder included in the rotation driving device 200 is detected, to detect whether or not the recording drum 1 is rotated (step S12).

When the recording drum 1 is rotated, it is judged that an unbalance occurs in the recording drum 1 (step S17). Even in a case where an unbalance occurs in the recording drum 1, the recording drum 1 is not rotated when an unbalance amount vector of the recording drum 1 coincides with the direction of the gravity of the recording drum 1 when the excitation of the servo motor is released.

When the recording drum 1 is not rotated, the recording drum 1 is rotated through an angle of 90° by the rotation driving device 200 (step S13). The excitation of the servo motor in the rotation driving device 200 is released, to bring the recording drum 1 into a free state (step S14).

In this state, it is detected whether or not the recording drum 1 is rotated (step S15). When the recording drum 1 is rotated, it is judged that an unbalance occurs in the recording drum 1 (step S17). On the other hand, when the recording drum 1 is not rotated, it is judged that the recording drum 1 is in a balanced state (step S16).

The unbalance of the recording drum 1 can be thus reliably detected. In this example, when the recording drum 1 is rotated by the first release of the excitation of the servo motor, the recording drum 1 is rotated through an angle of 90°. An angle of rotation is not limited to 90°. For example, it may be another angle.

Examples of processing after the unbalance detection at the step S11 include the following two types of processing. The first processing is for returning the plate 2 to the second conveying path 92 in the conveying unit 900, as shown in FIG. 15. In this case, the worker replaces the plate 2 returned to the second conveying path 92 in the conveying unit 900 with another plate having an inputted size, or sets the plate 2 on the first conveying path 92 in the conveying unit 900 again, to enter the correct size of the plate 2 from the operation panel 500 again.

The second processing is for calculating the position where each of the balance weights 7 on both end surfaces of the recording drum 1 is disposed on the basis of the size of the plate 2 detected at the step S5, and moving the balance weight 7 to the calculated position. Thereafter, the unbalance detection processing shown in FIG. 18 may be performed again.

Figure 19:
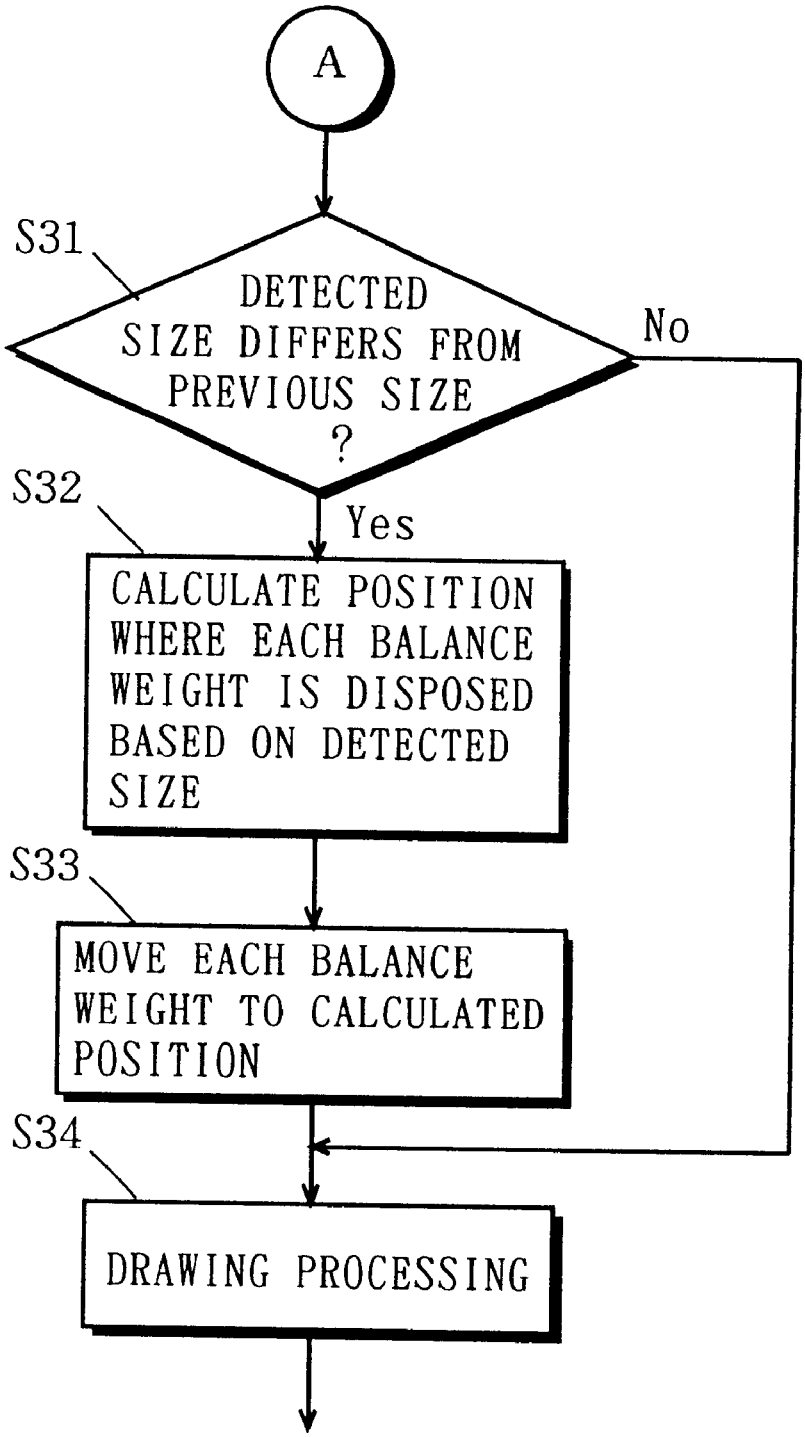
FIG. 19 is a flow chart showing another example of operations of the drawing apparatus shown in FIGS. 9 and 10.

FIG. 19 is a flow chart showing another example of operations of the drawing apparatus shown in FIGS. 9 and 10. In FIG. 19, processing previous to the step S31 is the same as the processing at the steps S1 to S5 shown in FIG. 16.

After the step S5 shown in FIG. 16, the controller 400 judges whether or not the detected size of the plate 2 differs from the size of the previous plate (step S31). When the detected size of the plate 2 differs from the size of the previous plate, the position where each of the balance weights 7 is disposed on both the end surfaces of the recording drum 1 is calculated on the basis of the detected size of the plate 2 (step S32). Each of the balance weights 7 on both the end surfaces of the recording drum 1 is moved to the calculated position (step S33).

Thereafter, drawing processing is performed by the recording head 120 shown in FIGS. 9 and 10 (step S34). When the size of the plate 2 detected at the step S31 is the same as the size of the previous plate, drawing processing is performed by the recording head 120 shown in FIGS. 9 and 10 (step S34) without calculating the position where each of the balance weights 7 is disposed (step S32) and moving the balance weight 7 (step S33).

The unbalance detection processing (step S9) and the processing after unbalance detection (step S11) may be performed similarly to the operations shown in FIG. 17 before the drawing processing at the step S34.

According to the above-mentioned operations of the drawing apparatus in the present embodiment, the size of the plate 2 is automatically detected, and the balance weight 7 is disposed in the position where no unbalance occurs in the recording drum 1 on the basis of the detected size of the plate 2. Therefore, an unbalance is prevented from occurring on the recording drum 1 by an input error of the size of the plate 2 by the worker. Consequently, the drawing apparatus is prevented from being damaged by forced vibration in the recording drum 1.

Although in the above-mentioned embodiment, the length of the plate 2 is detected by the plate front end detecting sensor 970 and the plate rear end detecting sensor 971 in the conveying unit 900, a sensor for detecting the width, the thickness, and so forth of the plate 2 may be provided in the conveying unit 900 or the like.

Although in the above-mentioned embodiment, the worker enters the size of the plate 2 as information relating to the plate 2 and detects the size of the plate 2, and calculates the position where each of the balance weights 7 is disposed on the basis of the inputted size of the plate 2 or the detected size of the plate 2, the worker may enter the size of the plate 2 and the other information relating to the weight thereof, for example, as the information relating to the plate 2, detect the size of the plate 2 and the other information relating to the weight thereof, and calculate the position where each of the balance weights 7 is disposed on the basis of the inputted information relating to the plate 2 or the detected information relating to the plate 2.

FIGS. 20 to 24 are diagrams showing other examples of a balance weight attaching method, where (a) is a front view, and (b) is a side view.

Figure 20A:
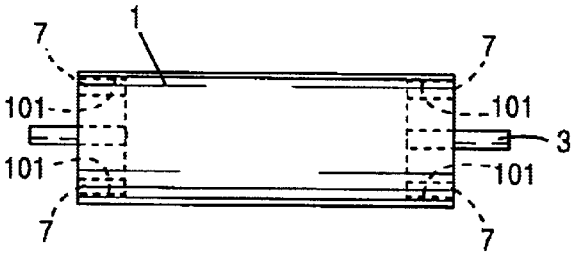
FIGS. 20(*a*) and 20(*b*) are front views and side views showing another example of a balance weight attaching method.
Figure 20B:
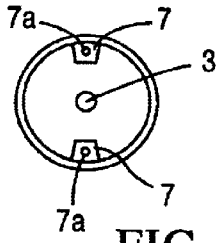

In the example shown in FIG. 20, cylinders 101 made of a metal are respectively extended at both ends of a recording drum 1. Two balance weights 7 are disposed so as to be movable and fixable in the circumferential direction on an inner peripheral surface of each of the cylinders 101. Each of the balance weights 7 is composed of a permanent magnet, and is attracted to the inner peripheral surface of the cylinder 101 by its magnetic force.

A hole 7*a* into which the adjusting pin 16 of the weight position adjuster 15 shown in FIG. 1 can be inserted is formed in each of the balance weights 7. When the recording drum 1 is rotated in a state where the adjusting pin 16 is inserted into the hole 7*a* of the balance weight 7, the balance weight 7 is moved in the circumferential direction along the inner peripheral surface of the cylinder 101. After position adjustment, the balance weight 7 is fixed to the inner peripheral surface of the cylinder 101 by the magnetic force.

Figure 21A:
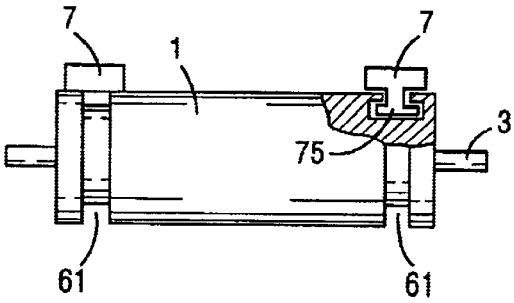
FIGS. 21(*a*) and 21(*b*) are front views and side views showing another example of a balance weight attaching method.
Figure 21B:
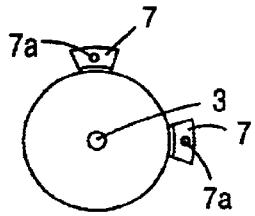

In the example shown in FIG. 21, annular grooves 61 along the circumference of a recording drum 1 are respectively formed near both ends of an outer peripheral surface of the recording drum 1. An engagement part 75 in an inverted T shape of two balance weights 7 is mounted on each of the annular grooves 61 so as to be movable and fixable in the circumferential direction. Each of the balance weights 7 is composed of a permanent magnet, and is attracted to an inner surface of the annular groove 61 of the recording drum 1 made of a metal by its magnetic force.

A hole 7*a* into which the adjusting pin 16 of the weight position adjuster 15 shown in FIG. 1 can be inserted is formed in each of the balance weights 7. In this example, the weight position adjuster 15 shown in FIG. 1 is arranged ahead of or behind the recording drum 1. When the recording drum 1 is rotated in a state where the adjusting pin 16 is inserted into the hole 7*a* of the balance weight 7, the balance weight 7 is moved in the circumferential direction along the annular groove 61 on the outer peripheral surface of the recording drum 1. After position adjustment, the balance weight 7 is fixed to the annular groove 61 by the magnetic force.

Figure 22A:
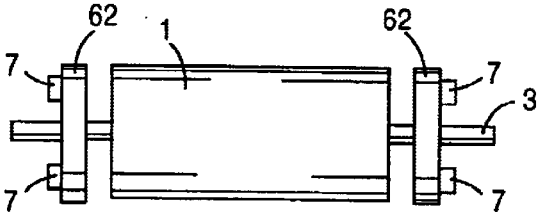
FIGS. 22(*a*) and 22(*b*) are front views and side views showing another example of a balance weight attaching method.
Figure 22B:
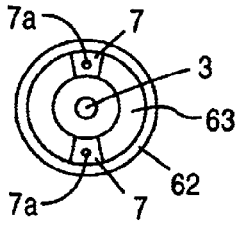

In the example shown in FIG. 22, auxiliary members 62 in a disk shape are respectively fixed to both ends of a rotary shaft 3 of a recording drum 1. An annular groove 63 along the circumference whose center is the rotary shaft 3 of the recording drum 1 is formed on one surface of each of the auxiliary members 62. Two balance weights 7 are attached so as to be movable and fixable in the circumferential direction inside each of the annular grooves 63. An inner surface of the annular groove 63 in the auxiliary member 62 is made of a metal. Each of the balance weights 7 is composed of a permanent magnet, and is attracted to the inner surface of the annular groove 63 in the auxiliary member 62 by its magnetic force.

A hole 7*a* into which the adjusting pin 16 of the weight position adjuster 15 shown in FIG. 1 can be inserted is formed in each of the balance weights 7. When the auxiliary member 62, together with the recording drum 1, is rotated in a state where the adjusting pin 16 is inserted into the hole 7*a* of the balance weight 7, the balance weight 7 is moved in the circumferential direction along the annular groove 63 in the auxiliary member 62. After position adjustment, the balance weight 7 is fixed to the annular groove 63 in the auxiliary member 62 by the magnetic force.

Figure 23A:
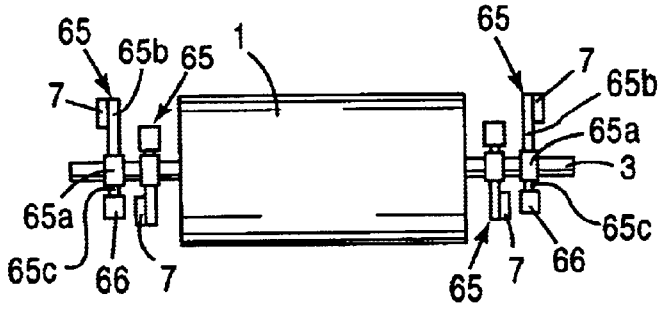
FIGS. 23(*a*) and 23(*b*) are front views and side views showing another example of a balance weight attaching method.
Figure 23B:
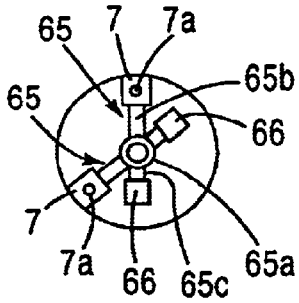

In the example shown in FIG. 23, two arm members 65 are attached to each of both ends of a rotary shaft 3 of a recording drum 1 so as to be rotatable and fixable around and to the rotary shaft 3. The arm member 65 is constituted by a cylindrical attachment part 65*a* fitted in the rotary shaft 3 and a long arm 65*b* and a short arm 65*c*. A balance weight 7 is fixed to an end of the long arm 65*b*, and a balancer 66 is provided at an end of the short arm 65*c*. The balance 66 keeps the balance of the arm member 65 when there is no balance weight 7. The attachment unit 65*a* in the arm member 65 is composed of a permanent magnet, and is attracted to the rotary shaft 3 made of a metal by its magnetic force.

A hole 7*a* into which the adjusting pin 16 of the weight position adjuster 15 shown in FIG. 1 can be inserted is formed in each of the balance weights 7. When the rotary shaft 3, together with the recording drum 1, is rotated in a state where the adjusting pin 16 is inserted into the hole 7*a* of the balance weight 7, the arm member 65 is rotated around the rotary shaft 3, and the balance weight 7 fixed to the arm member 65 is moved along the circumference of the recording drum 1. After position adjustment, the arm member 65 is fixed to the rotary shaft 3 by the magnetic force.

The arm member 65 may be attached to the rotary shaft 3 so as to be rotatable and fixable by respectively providing the rotary shaft 3 and the attachment part 65*a* of the arm member 65 with ratchet structures instead of forming the attachment part 65*a* of the arm member 65 of a permanent magnet.

Figure 24A:
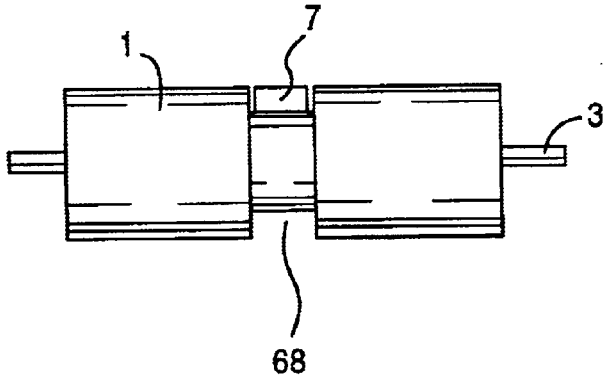
FIGS. 24(*a*) and 24(*b*) are front views and side views showing another example of a balance weight attaching method.
Figure 24B:
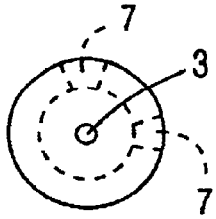

In the example shown in FIG. 24, an annular groove 68 is formed at the center of an outer peripheral surface of a recording drum 1. Two balance weights 7 are disposed so as to be movable and fixable in the circumferential direction inside the annular groove 68. Each of the balance weights 7 is composed of a permanent magnet, and an inner surface of the annular groove 68 of the recording drum 1 is made of a metal. It is preferable that the balance weights 7 are provided such that the surfaces of the balance weights 7 and the outer peripheral surface of the recording drum 1 are flush with each other.

Figure 25:
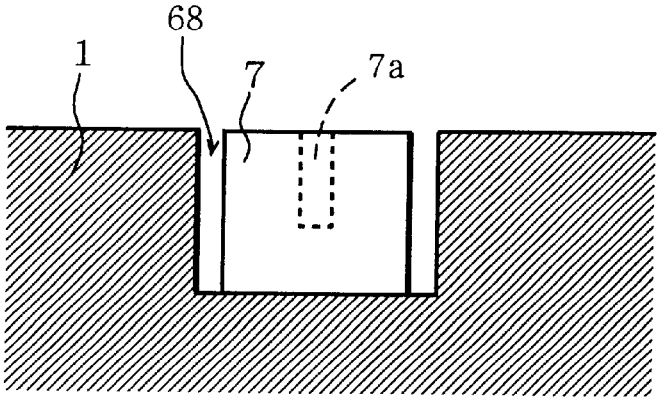
FIG. 25 is a cross-sectional view showing a first example of the position where a balance weight is attached in the balance weight attaching method shown in FIG. 24.
Figure 26:
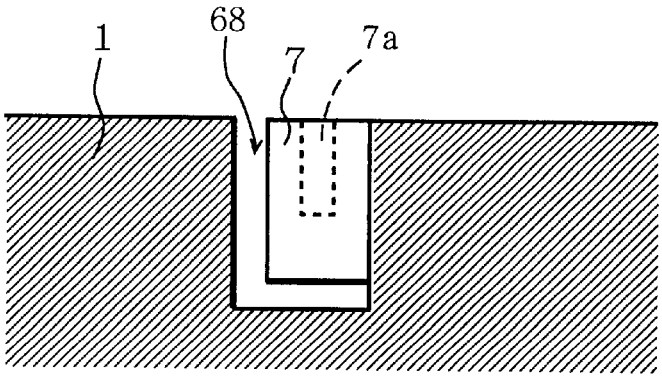
FIG. 26 is a cross-sectional view showing a second example of the position where a balance weight is attached in the balance weight attaching method shown in FIG. 24.
Figure 27:
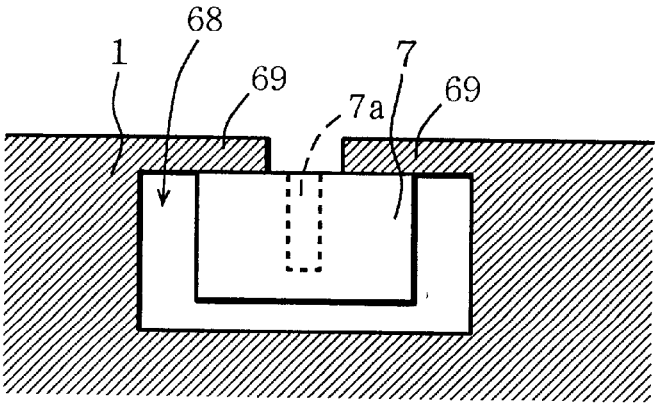
FIG. 27 is a cross-sectional view showing a third example of the position where a balance weight is attached in the balance weight attaching method shown in FIG. 24.

As shown in FIG. 25, each of the balance weights 7 may be fixed to the bottom surface of the annular groove 68 of the recording drum 1 by its magnetic force. As shown in FIG. 26, each of the balance weights 7 may be fixed to a side surface of the annular groove 68 of the recording drum 1 by its magnetic force. Further, as shown in FIG. 27, flanges 69 may extend inward from upper ends of both side surfaces of the annular groove 68, and each of the balance weights 7 may be fixed to the inner surface of the flange 69 by its magnetic force. As shown in FIGS. 25 to 27, a hole 7*a* into which the adjusting pin 16 of the weight position adjuster 15 shown in FIG. 1 can be inserted is formed in each of the balance weights 7.

In the example shown in FIG. 24, the weight position adjuster 15 is arranged ahead of or behind the recording drum 1. When the recording drum 1 is rotated in a state where the adjusting pin 16 is inserted into the hole 7*a* of the balance weight 7, the balance weight 7 is moved in the circumferential direction along the annular groove 68 of the recording drum 1. After position adjustment, the balance weight 7 is fixed in the annular groove 68 of the recording drum 1 by its magnetic force. In the example shown in FIG. 24, an unbalance force exerted on the recording drum 1 can be canceled by the two balance weights 7.

Figure 28:
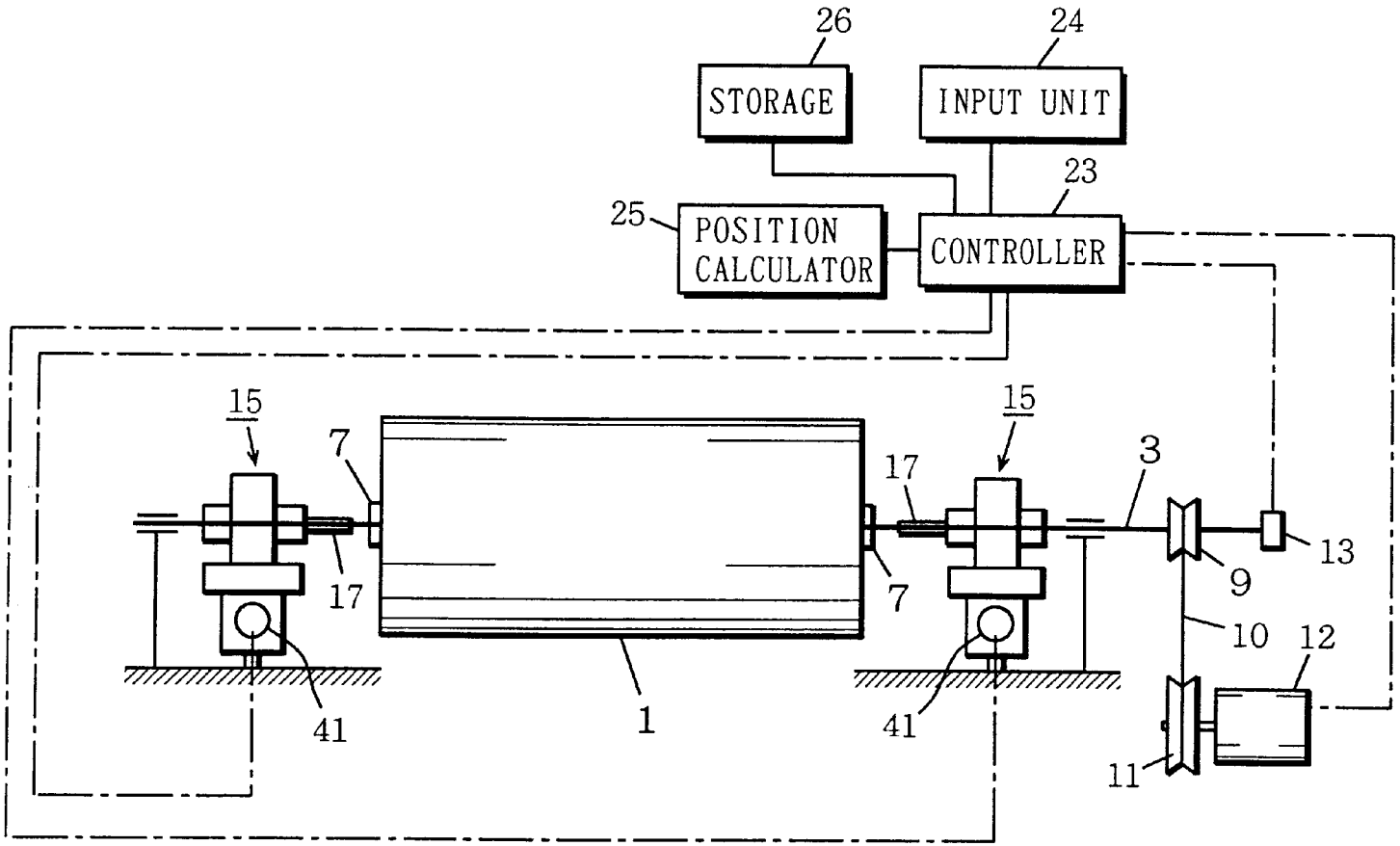
FIG. 28 is a schematic view showing the construction of a drawing apparatus according to a fifth embodiment of the present invention.
Figure 29:
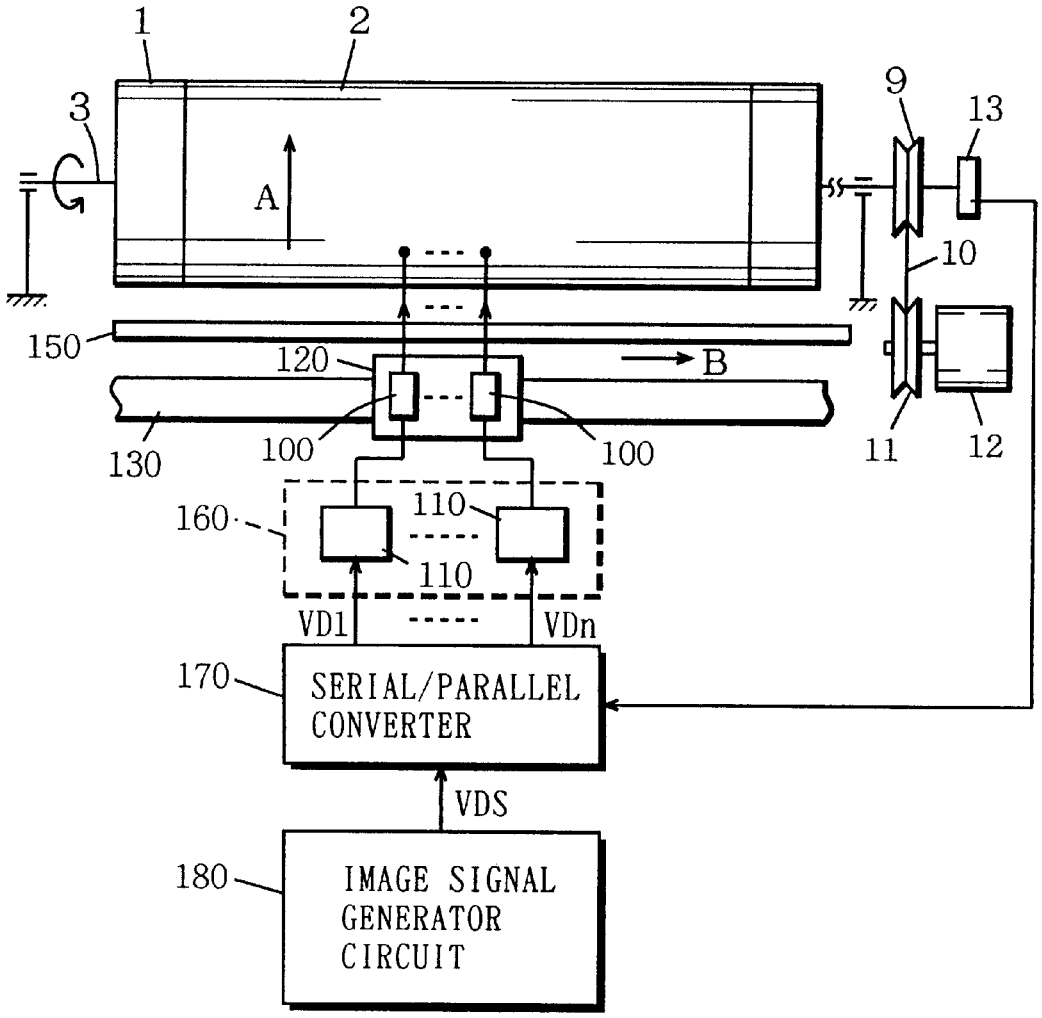
FIG. 29 is a schematic view of a principal part of the drawing apparatus shown in FIG. 28.

FIG. 28 is a schematic view of a drawing apparatus in a fifth embodiment of the present invention, and FIG. 29 is a schematic view of a principal part of the drawing apparatus shown in FIG. 28.

In FIG. 28, the drawing apparatus comprises a cylindrical recording drum 1. The recording drum 1 is rotatably supported so as to be movable around a rotary shaft 3 having both its ends supported on bearings. A driving mechanism comprising a pair of pulleys 9 and 11, a belt 10 and a motor 12 is connected to one end of the rotary shaft 3. The driving mechanism transmits the rotation of the motor 12 to the rotary shaft 3 through the pair of pulleys 9 and 11 and the belt 10, to rotate the recording drum 1.

In FIG. 29, a recording head 120 is disposed in a position opposite to an outer peripheral surface of the recording drum 1. The recording head 120 comprises a plurality of laser diodes 100. The recording head 120 is attached to a guide 130 so as to be movable, and is moved in a secondary scanning direction B in synchronization with the rotation of the recording drum 1.

The current position in a primary scanning direction A of a plate 2 is detected on the basis of a detection signal outputted from a rotation angle detector 13 attached to the rotary shaft 3 of the recording drum 1. The current position in the secondary scanning direction B of the recording head 120 is detected on the basis of a detection signal outputted from a linear encoder 150.

The plurality of laser diodes 100 in the recording head 120 are driven by a laser diode driving circuit portion 160. The laser diode driving circuit portion 160 comprises a plurality of laser diode driving circuits 110 corresponding to the plurality of laser diodes 100 in the recording head 120.

An image signal generator circuit 180 generates a serial image signal VDS. A serial/parallel converter 170 converts the serial image signal VDS generated by the image signal generator circuit 180 into parallel image signals VD1 to VDn, and respectively feeds the image signals VD1 to VDn to the plurality of laser diode driving circuits 110 in the laser diode driving circuit portion 160. Consequently, each of the laser diodes 100 in the recording head 120 is driven by the corresponding laser diode driving circuit 110, to irradiate the plate 2 with laser light.

Figure 30:
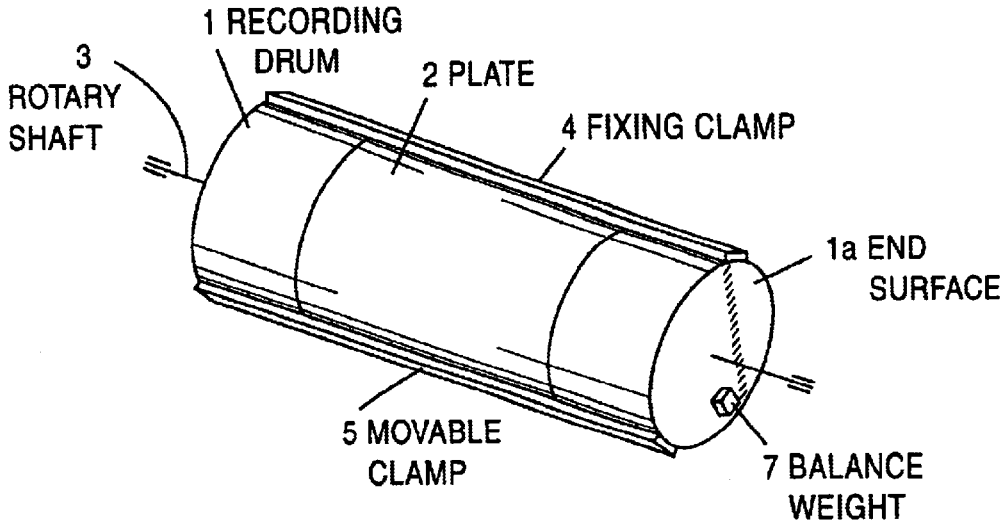
FIG. 30 is a perspective view of a recording drum.
Figure 31:
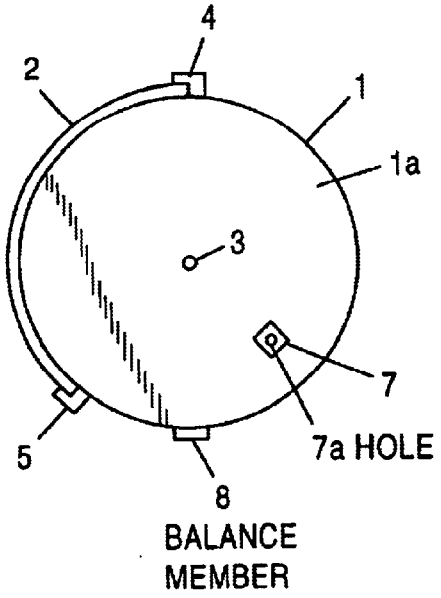
FIG. 31 is a side view of the recording drum shown in FIG. 29.

FIG. 30 is a perspective view of the recording drum, and FIG. 31 is a side view of the recording drum. A fixing clamp 4 and a movable clamp 5 for attaching the plate 2 are disposed on the outer peripheral surface of the recording drum 1. The fixing clamp 4 is fixed to the outer peripheral surface of the recording drum 1, and the movable clamp 5 is formed so as to be movable on the outer peripheral surface of the recording drum 1 depending on the size of the plate 2. A fixing clamp balance member 8 is attached to the outer peripheral surface of the recording drum 1 on the opposite side of the fixing clamp 4. The fixing clamp balance member 8 is formed so as to have an approximately equal weight to that of the fixing clamp 4. Consequently, the fixing clamp balance member 8 develops a centrifugal force which is balanced with a centrifugal force developed by the fixing clamp 4 at the time of rotating the recording drum 1, thereby preventing an unbalance force from being produced.

One balance weight 7 is disposed on each of both end surfaces 1*a* of the recording drum 1. The balance weight 7 is composed of a permanent magnet, and is attracted to the end surface 1*a* of the recording drum 1 made of a metal by its magnetic force. A hole 7*a* into which an engaging pin 17 of a weight position adjuster 15 is to be inserted is formed on the surface of the balance weight 7. The balance weight 7 is arranged in a position on the end surface 1*a* which is rotatable in a state where centrifugal forces developed by the respective members which are exerted on the rotary shaft 3 of the recording drum 1 are balanced with each other. The arrangement and the operation of the balance weights 7 will be described in detail later.

Figure 32A:
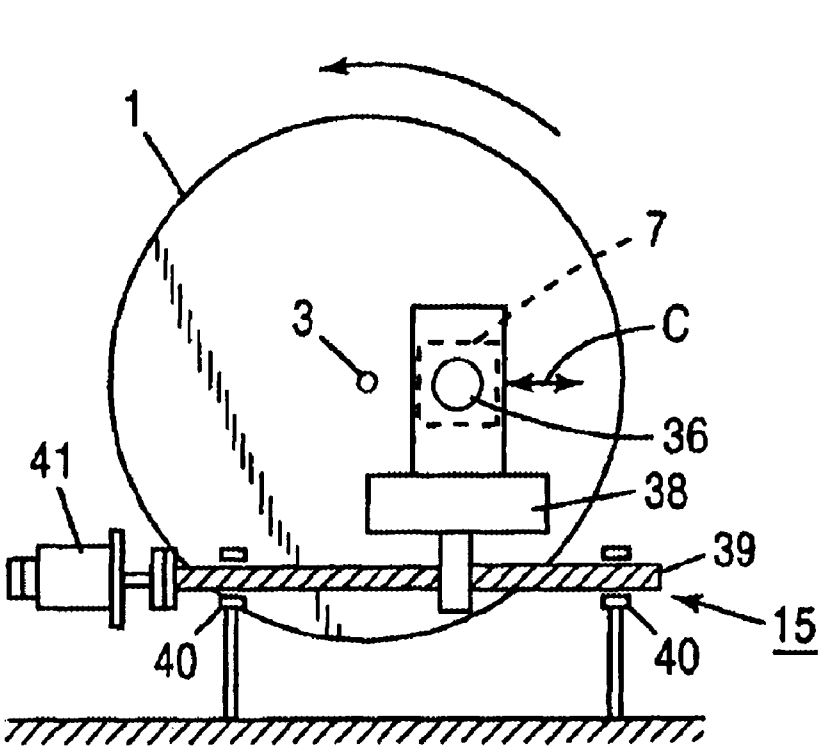
FIGS. 32(*a*) and 32(*b*) are side views and front views of a weight position adjuster in the drawing apparatus.
Figure 32B:
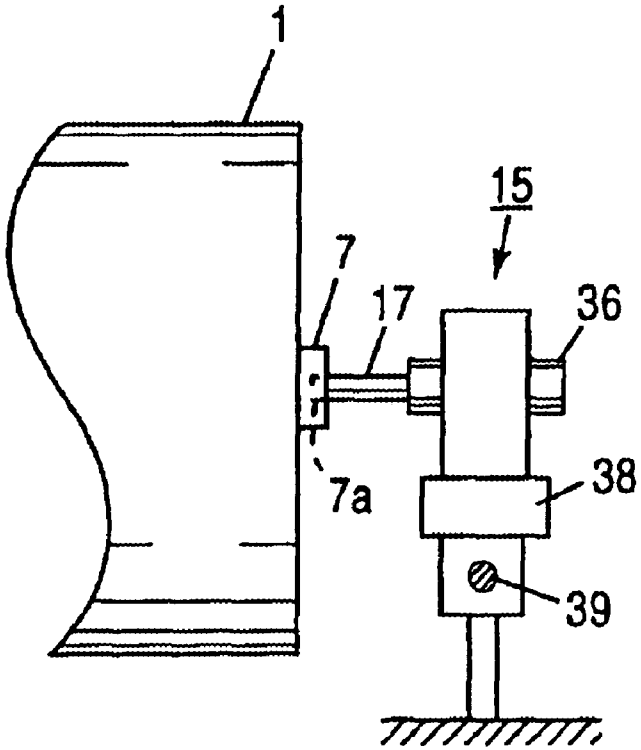

A pair of weight position adjusters 15 is arranged opposite to both the end surfaces 1*a* of the recording drum 1. FIG. 32 is a side view (a) and a front view (b) of the weight position adjuster 15. In FIGS. 28 and 32, the weight position adjuster 15 has an engaging pin 17 which can advance and retreat to and from the end surface 1*a* of the recording drum 1. The engaging pin 17 is so moved as to advance and retreat to and from the balance weight 7 by a cylinder 36. The cylinder 36 is supported on a supporting member 38. The supporting member 38 is engaged with a feed screw 39 extending in a direction parallel to the end surface 1*a* of the recording drum 1, and is moved back and forth in a direction C parallel to the end surface 1*a* of the recording drum 1 as the feed screw 39 is rotated. The feed screw 39 is composed of a ball screw, and both ends thereof are respectively supported by bearings 40. A motor 41 is connected to one end of the feed screw 39. The motor 41 is rotatable forward and backward. The feed screw 39 is rotated by the rotation of the motor 41. Consequently, the cylinder 36 and the engaging pin 17 which are supported on the supporting member 38 are moved back and forth in the direction C parallel to the end surface 1*a* of the recording drum 1.

A controller 23 receives a detection signal from the rotation angle detector 13, and controls each of the operations of the motor 12 for rotating the recording drum 1 and the pair of weight position adjusters 15.

An input unit 24 inputs information relating to the size, the weight, and so forth of the plate 2. A position calculator 25 calculates the position where the balance weight 7 is disposed on the basis of data representing the physical properties of the plate 2 which is inputted from the input unit 24. Further, a storage 26 stores the position where the balance weight 7 is disposed.

In the present embodiment, the recording drum 1 corresponds to a drum in the present invention, the driving mechanism corresponds to driving means, the movable clamp 5 corresponds to a fixing member, and the balance weight 7 corresponds to a balance weight. Further, the position calculator 25 corresponds to position calculation means, the controller 23 corresponds to control means, the weight position adjuster 15 corresponds to engagement means, the storage 26 corresponds to storage means, and the input unit 24 corresponds to input means.

Description is now made of an operation for adjusting the positions of the balance weights 7 in the drawing apparatus. The operation for adjusting the positions of the balance weights 7 is performed by the step of calculating an unbalance force, the step of calculating the position where the balance weight is disposed, and the step of adjusting the position of the balance weight on the basis of control carried out by the controller 23.

When drawing processing of a new plate which differs in the size and the weight from the plate in preprocessing, information relating to the size, the weight, and so forth of the plate is previously inputted from the input unit 24. Thereafter, the following steps are carried out.

(1) Step of Calculating Unbalance Force

When the recording drum 1 is rotated at high speed, the fixing clamp 4, the movable clamp 5, the plate 2, and the fixing clamp balance member 8 which are disposed on the outer peripheral surface of the recording drum 1 respectively develop centrifugal forces directed outward along the radius of the recording drum 1 from the positions of their respective centers of gravity. Generally, the members are not disposed in consideration of a balance among the respective centrifugal forces. Therefore, an unbalance force is caused by variations in the directions in which the centrifugal forces are exerted and the sizes thereof. The unbalance force is periodically changed in the direction in which it is exerted as the recording drum 1 is rotated. Therefore, forced vibration occurs in the rotary shaft 3 of the recording drum 1, causing the recording drum 1 to develop a fault.

Therefore, the position calculator 25 calculates as follows the unbalance force exerted on the recording drum 1 on the basis of the inputted information relating to the size, the mass, and so forth of the plate 2 in addition to the information relating to the position, the mass, and so forth of each of the members.

FIG. 33 is a schematic view (a) showing an unbalance force caused by the centrifugal forces developed by the movable clamp and the plate in the recording drum, and a diagram (b) of an unbalance force vector. In the following description, equations expressing the centrifugal force produced in the recording drum 1, the unbalance force exerted on the recording drum 1, and a balance force for canceling the unbalance force include a common term of rotation angular velocity. In the following description, the common term of rotation angular velocity is omitted. Consequently, the unbalance force and the balance force from which the common term of rotation angular velocity is omitted are respectively referred to as an unbalance amount D and a balance amount B.

The fixing clamp 4 and the fixing clamp balance member 8 are arranged such that their respective centrifugal forces are balanced with each other. Therefore, the fixing clamp 4 and the fixing clamp balance member 8 are excluded from the following calculation of the unbalance amount D.

Furthermore, in the following description, the rotary shaft 3 is taken as a center of rotation, and an X-Y coordinate system using as the Y-axis a direction passing through the center of rotation and the fixing clamp 4 and using as the X-axis a direction perpendicular to the Y-axis is fixed on the end surface of the recording drum 1. Further, the circumferential direction in a counterclockwise direction from the Y-axis is taken as a θ direction.

As shown in FIG. 33(*a*), when the recording drum 1 is rotated at high speed, the plate 2 develops a centrifugal force Fg in its center of gravity G. An angle in the circumferential direction of the centrifugal force Fg developed by the plate 2 is taken as θg.

The movable clamp 5 develops a centrifugal force Fc in its center of gravity. Let θc be an angle in the circumferential direction of the centrifugal force Fc developed by the movable clamp 5.

A composite amount of the centrifugal force Fg developed by the plate 2 and the centrifugal force Fc developed by the movable clamp 5 is exerted as the unbalance amount D on the rotary shaft 3 of the recording drum 1.

In FIG. 33(*b*), letting Dx and Dy be a component in the X-axis direction and a component in the Y-axis direction of the unbalance amount D, respectively, Dx and Dy are found by the following equations from the centrifugal forces Fg and Fc:

$$\begin{aligned} Dx &= Fgx + Fcx \\ &= Fg \cdot \sin\theta g + Fc \cdot \sin(\pi - \theta c) \\ &= Mg \cdot Rg \cdot \sin\theta g - Mc \cdot Rc \cdot \sin\theta c \end{aligned} \tag{11}$$

$$\begin{aligned} Dy &= Fgy + Fcy \\ &= Fg \cdot \cos\theta g + Fc \cdot \cos(\pi - \theta c) \\ &= Mg \cdot Rg \cdot \cos\theta g + Mc \cdot Rc \cdot \cos\theta c \end{aligned} \tag{12}$$

Mg: mass of plate

Mc: mass of movable clamp

Rg: distance from rotary shaft to center of gravity G of plate

Rc: distance from rotary shaft to center of gravity of movable clamp

In the equations (11) and (12), Fgx and Fgy respectively indicate a component in the X-axis direction and a component in the Y-axis direction of the centrifugal force Fg, and Fcx and Fcy respectively indicate a component in the X-axis direction and a component in the Y-axis direction of the centrifugal force Fc.

Furthermore, letting $\theta_D$ be an angle in the circumferential direction in which the unbalance amount D is exerted, the unbalance amount D and the angle $\theta_D$ in the circumferential direction are respectively expressed by the following equations:

$$D=\sqrt{Dx^{2+Dy^2}} \tag{13}$$

in case of Dx<0

$$\theta_D = \frac{\pi}{2} - \tan^{-1}\frac{Dy}{Dx} \tag{14}$$

in case of Dx≧0

$$\theta_D = \frac{3}{2}\pi + \tan^{-1}\frac{Dy}{Dx} \tag{15}$$

Consequently, the unbalance amount D and the direction in which it is exerted are found.

(2) Step of Calculating Position Where Balance Weight is Disposed

When the unbalance amount D and the direction in which the unbalance amount is exerted are found, the position calculator 25 calculates as follows such a balance amount B as to cancel the unbalance amount D.

Figure 34:
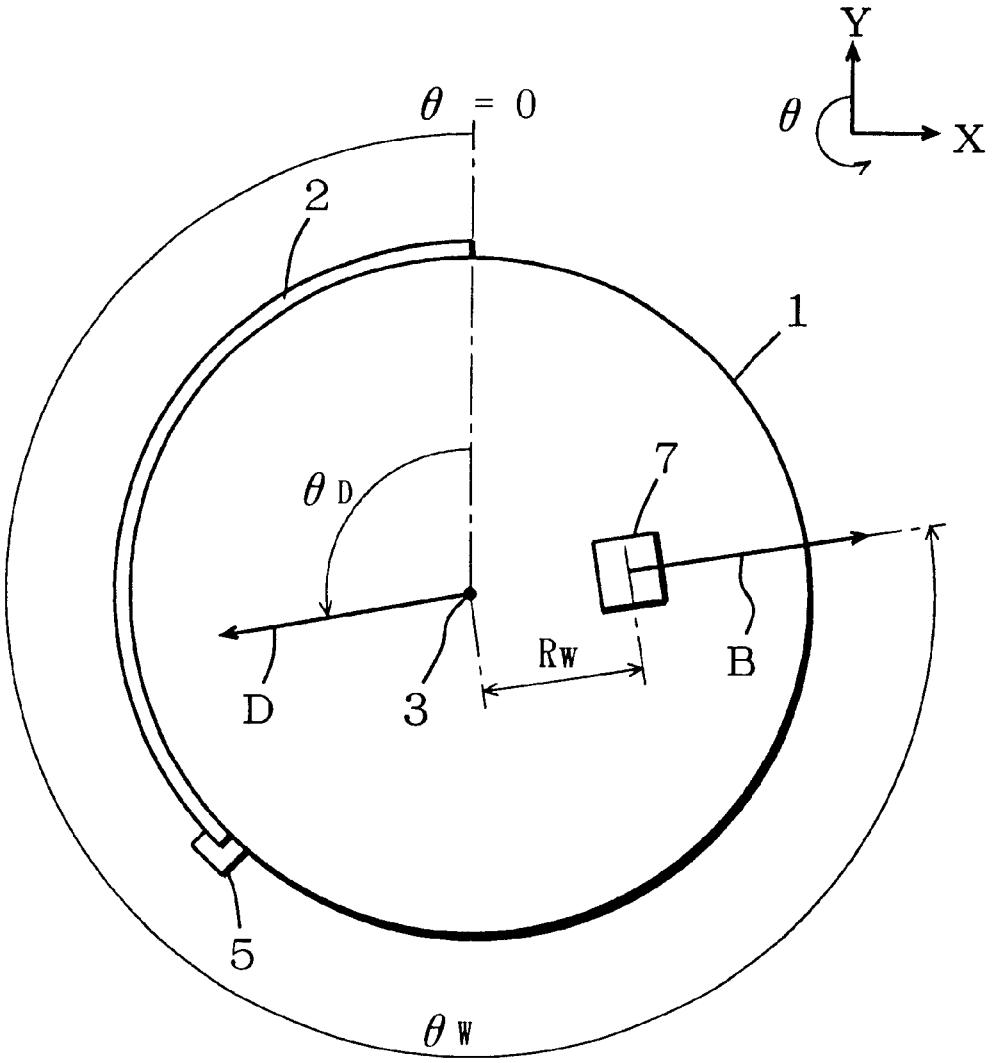
FIG. 34 is a schematic view showing a balance force caused by centrifugal forces developed by balance weights in the recording drum.

FIG. 34 is a schematic view showing an unbalance force caused by centrifugal forces developed by the balance weights in the recording drum. In FIG. 34, the balance amount B is so set as to be equal to the unbalance amount D, and to be exerted in the opposite direction to the unbalance amount D. The balance amount B is a composite amount of centrifugal forces Fw developed by two balance weights 7 on both the end surfaces of the recording drum 1.

The mass of each of the balance weights 7 is previously determined. Letting Mw be the mass of each of the balance weights 7, and letting Rw be the distance from the center of the rotary shaft 3 to the center of gravity of each of the balance weights 7, a centrifugal force Fw developed by the balance weight 7 is expressed by the following equation:

$$Fw=Mw\times Rw \tag{16}$$

A composite amount of the centrifugal forces Fw developed by the two balance weights 7 arranged on both the end surfaces of the recording drum 1, that is, the balance amount B is expressed by the following equation:

$$B=2\cdot Fw=2\times Mw\times Rw \tag{17}$$

The balance amount B may be equal to the unbalance weight D previously found. When the mass of the balance weight 7 is constant, the distance Rw in the radial direction of the balance weights 7 from the rotary shaft 3 which satisfies the relationship expressed by the equation (17) may be found by the following equation:

$$Rw=B/(2\cdot Mw) \tag{18}$$

Angles in the circumferential direction of the balance weights 7 (attaching angles) θw are found by the following equation:

$$\theta w=\theta_D+\pi \tag{19}$$

(3) Step of Adjusting Position of Balance Weight

When the distance Rw in the radial direction of the two balance weights from the rotary shaft 3 and the attaching angles θw in the circumferential direction of the balance weights 7 are found by the foregoing steps (1) and (2), the balance weights 7 are moved to the found positions in the radial direction and the circumferential direction.

In FIG. 28, the distance Rw in the radial direction of the balance weights 7 and the attaching angles θw in the circumferential direction of the balance weights 7 on the end surfaces of the recording drum 1 at the time of transmitting the previous drawing processing are stored on the storage 26. The controller 23 drives the motor 12 on the basis of information relating to the current position where the recording drum 1 is rotated and information relating to the position where the balance weight 7 is disposed from the rotation angle detector 13, and rotates the recording drum 1 so that the position in the vertical direction of the hole 7*a* of the balance weight 7 coincides with the position in the vertical direction of the engaging pin 17 of the position adjuster 15. Further, the motor 41 is driven, and the feed screw 39 is rotated, to move the supporting member 38 along the radius on the end surface 2*a* of the recording drum 1 so that the positions of the hole 7*a* of the balance weight 7 and the engaging pin 17 coincide with each other in the horizontal direction.

In this state, the engaging pin 17 is extended, and is inserted into the hole 7*a* of the balance weight 7. The feed screw 39 is driven, and the engaging pin 17 is moved in the radial direction, to move the balance weight 7 to a position at the distance Rw in the radial direction that is found in the above-mentioned step (2).

Furthermore, the recording drum 1 is rotated in a state where the engaging pin 17 is inserted into the hole 7*a* of the balance weight 7, to relatively move the balance weight 7 to the position at the attaching angle θw in the circumferential direction which is found in the above-mentioned step (2). Thereafter, the engaging pin 17 is caused to retreat. Consequently, the adjustment of the position of the balance weight 7 is terminated. The positions of the balance weights 7 are simultaneously adjusted on both the end surfaces 1*a* of the recording drum 1.

By the foregoing steps, four balance weights 7 are disposed such that they are balanced with the centrifugal forces developed by the plate 2 and the movable clamp 5. Consequently, the recording drum 1 can be rotated at high speed without causing forced vibration in the bearings of the rotation shaft 3.

The end 1*a* of the recording drum 1 and the surface to which the balance weight 7 is attracted are not limited to flat surfaces. For example, they may be respectively provided with grooves extending along the circumference whose center is the rotary shaft 3 of the recording drum 1. In this case, the grooves on the end surface 1*a* and the surface to which the balance weight 7 is attracted are meshed with each other, thereby making it possible to prevent the balance weight 7 from being moved in the radial direction and separated by the rotation at high speed of the recording drum 1.

Although in the drawing apparatus according to the above-mentioned embodiment is so constructed as to adjust the positions of the balance weights 7 using the weight position adjuster 15, a worker may find the positions where the balance weights 7 are disposed, and then directly attach the balance weights 7 to the positions on both the end surfaces of the recording drum 1. In this case, the necessity of the weight position adjuster 15 is eliminated, so that the construction of the drawing apparatus is simplified.

Furthermore, the balance weight 7 is not limited to a magnet. For example, the balance weight may have a structure in which it is mechanically attached to the end surface of the recording drum 1.

Figure 35A:
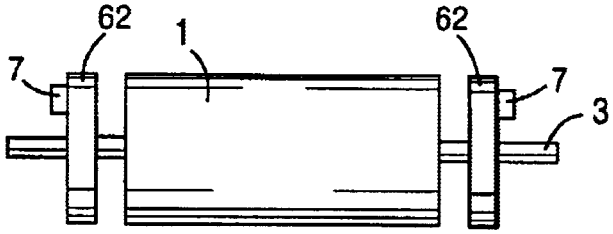
FIGS. 35(*a*) and 35(*b*) are front views and side views showing another example of a balance weight attaching method.
Figure 35B:
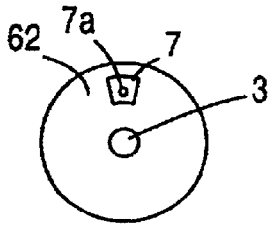
Figure 36A:
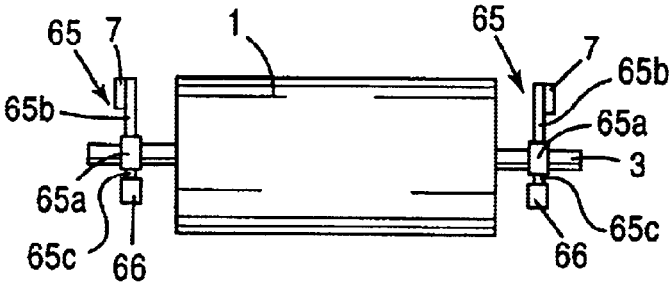
FIGS. 36(*a*) and 36(*b*) are front views and side views showing another example of a balance weight attaching method.
Figure 36B:
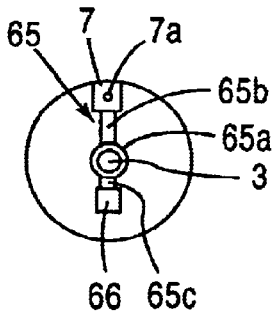
Figure 37:
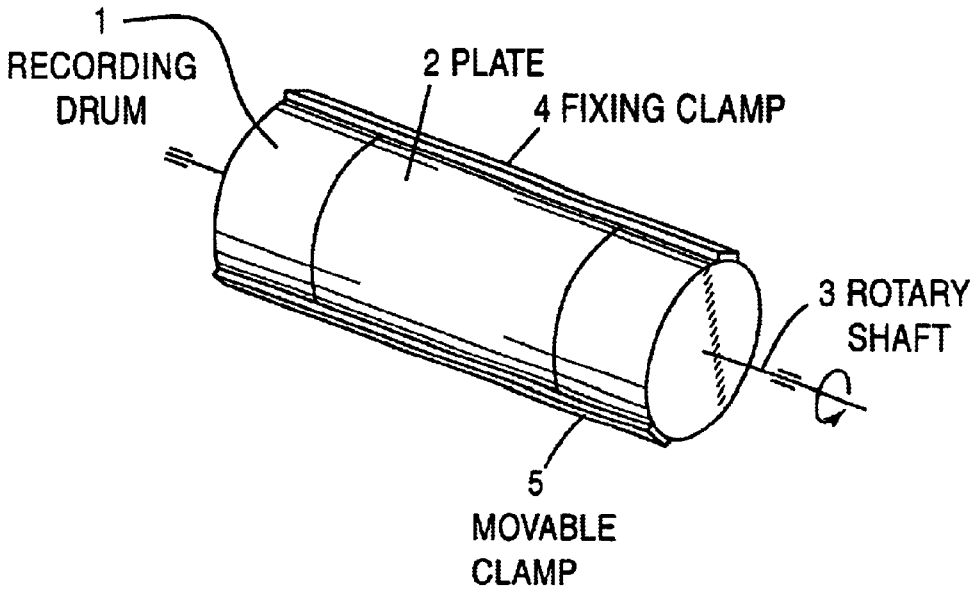
FIG. 37 PRIOR ART
FIG. 37 is a perspective view of a recording drum in a conventional drawing apparatus.

FIGS. 35 and 36 are diagrams showing another example of a method of attaching balance weights, where (a) is a front view, and (b) is a side view.

In the example shown in FIG. 35, auxiliary members 62 in a disk shape are respectively fixed to both ends of a rotary shaft 3 of a recording drum 1. One balance weight 7 is disposed so as to be movable and fixable in the circumferential direction and in the radial direction on one surface of each of the auxiliary members 62. The auxiliary member 62 is made of a metal. Each of the balance weights 7 is composed of a permanent magnet, and is attracted to the auxiliary member 62 by its magnetic force.

A hole 7*a* into which the engaging pin 17 of the weight position adjuster 15 shown in FIG. 28 can be inserted is formed in each of the balance weights 7. When the engaging pin 17 is moved along the radius whose center is the recording shaft 3 of the recording drum 1 in a state where the engaging pin 17 is inserted into the hole 7*a* of the balance weight 7, the balance weight 7 is moved in the radial direction on the auxiliary member 62. When the auxiliary member 62, together with the recording drum 1, is rotated in this state, the balance weight 7 is moved along the circumference whose center is the rotary shaft 3 of the recording drum 1 on the auxiliary member 62. After position adjustment, the balance weight 7 is fixed to the auxiliary member 62 by the magnetic force.

In the example shown in FIG. 36, one arm member 65 is attached to each of both ends of a rotary shaft 3 of a recording drum 1 so as to be rotatable and fixable around and to the rotary shaft 3. The arm member 65 is constituted by a cylindrical attachment part 65*a* fitted in the rotary shaft 3 and a long arm 65*b* and a short arm 65*c*. A balance weight 7 is fixed to the long arm 65*b* so as to be movable and fixable, and a balancer 66 is provided at an end of the short arm 65*c*. The balance 66 keeps a balance of the arm member 65 when there is no balance weight 7. The attachment part 65*a* of the arm member 65 is composed of a permanent magnet, and is attracted to the rotary shaft 3 made of a metal by its magnetic force. The long arm 65*b* of the arm member 65 is made of a metal. Each of the balance weights 7 is composed of a permanent magnet, and is attracted to the long arm 65*b* of the arm member 65 by its magnetic force.

A hole 7*a* into which the engaging pin 17 of the weight position adjuster 15 shown in FIG. 28 can be inserted is formed in each of the balance weights 7. When the engaging pin 17 is moved along the radius whose center is the rotary shaft 3 of the recording drum 1 in a state where it is inserted into the hole 7*a* of the balance weight 7, the balance weight 7 is moved in the radial direction on the long arm 65*b* of the arm member 65. When the rotary shaft 3, together with the recording drum 1, is rotated in this state, the arm member 65 is rotated around the rotary shaft 3, and the balance weight 7 attached to the arm member 65 is moved along the circumference of the recording drum 1. After position adjustment, the arm member 65 is fixed to the rotary shaft 3 by the magnetic force.

The arm member 65 may be attached to the rotary shaft 3 so as to be rotatable and fixable by providing the attachment part 65*a* of the arm member 65 with a ratchet structure instead of forming the attachment part 65*a* of the arm member 65 of a permanent magnet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A drawing apparatus, comprising:

a rotatable recording drum having a cylindrical surface to which a plate is fixed and having a rotation shaft;

a driving device that rotates said recording drum around the rotation shaft;

a recording head that irradiates a laser beam on the plate fixed to the cylindrical surface of said recording drum to directly record an image on the plate;

a front end clamp disposed on the cylindrical surface of said recording drum and having a plate fixing portion;

a rear end clamp attached in any of a plurality of positions at the cylindrical surface of said recording drum to fix the rear end of the plate;

a plate carry-in path that holds a plate to be recorded with an image over said recording drum;

a pair of rollers provided at the front end portion of said plate carry-in path for feeding the plate from said plate carry-in path;

a front end clamp opening/closing device that opens or closes said front end clamp;

a rear end clamp attaching/detaching device that attaches or detaches said rear end clamp to or from the cylindrical surface of said recording drum; and a controller that controls said driving device, said recording head, said pair of rollers, said front end clamp opening/closing device and said rear end clamp attaching/detaching device, wherein said controller controls said front end clamp opening/closing device to open said front end clamp;

controls the pair of rollers to feed the plate held on said plate carry-in path toward said front end clamp;

controls said front end clamp opening/closing device to close the plate fixing portion of said front end clamp to fix the front end of said plate on the cylindrical surface of said recording drum, controls said driving device to rotate said recording drum for a predetermined amount, and controls said rear end clamp attaching/detaching device to attach said rear end clamp to the cylindrical surface of said recording drum to fix the rear end of the plate on said cylindrical surface of said recording drum.

2. The drawing apparatus according to claim 1, further comprising a swinging device that changes the angle of said plate carry-in path to said recording drum.

3. The drawing apparatus according to claim 1, wherein said front end clamp opening/closing device and said rear end clamp attaching/detaching device are positioned close to each other.

4. The drawing apparatus according to claim 1, further comprising an input device that inputs attribute data related to the plate, wherein said controller controls said pair of rollers to feed the plate from said plate carry-in path toward said front end clamp, controls said driving device to rotate said recording drum for a predetermined amount, and controls said rear end clamp attaching/detaching device to attach said rear end clamp to the cylindrical surface of said recording drum, based on the attribute data related to the plate input from said input/device.

5. The drawing apparatus according to claim 4, further comprising a plate carry-out path that receives a plate recorded with an image on said recording drum, wherein said controller controls said driving device to rotate said recording drum so that the rear end of the plate recorded with an image by said recording head and fixed to said cylindrical surface faces said rear end clamp attaching/detaching device, controls said rear end clamp attaching/detaching device to detach said rear end clamp from the cylindrical surface of said recording drum, controls said driving device to rotate said recording drum, and controls said front end clamp opening/closing device to release pressing and fixing the front end of the plate by said front end clamp.

6. The drawing apparatus according to claim 5, wherein said plate carry-in path and said plate carry-out path are placed so as to overlap on each other.

7. The drawing apparatus according to claim 4, further comprising a balance weight that is disposed at the end surface of said recording drum and movable in the circumferential direction about the rotation shaft of said recording drum, and a weight moving device provided apart from said recording drum for moving said balance weight based on the attribute data of the plate input from said input device.

8. The drawing apparatus according to claim 1, further comprising a positioning pin disposed on the cylindrical surface of said recording drum for positioning the plate fed from said plate carry-in path.

9. The drawing apparatus according to claim 1, wherein said recording head includes a device selectively irradiating a plurality of laser beams.

10. The drawing apparatus according to claim 1, further comprising a balance weight disposed at an end surface of said recording drum for counterbalancing the weight of said front end clamp.

11. The drawing apparatus according to claim 1, wherein said recording head comprises a plurality of laser diodes.

* * * * *